US011339793B2

(12) United States Patent
Aiello et al.

(10) Patent No.: US 11,339,793 B2
(45) Date of Patent: May 24, 2022

(54) FAN FLOW DIRECTING FEATURES, SYSTEMS AND METHODS

(71) Applicant: Apple Inc., Cupertino, CA (US)

(72) Inventors: Anthony J. Aiello, Santa Cruz, CA (US); Cheng P. Tan, Fremont, CA (US); Jesse T. Dybenko, Santa Cruz, CA (US); Arash Naghib Lahouti, San Jose, CA (US); Eric R. Prather, Portola Valley, CA (US); Philippe P. Herrou, Mountain View, CA (US); Ashkan Rasouli, Santa Clara, CA (US); Brett W. Degner, Menlo Park, CA (US); Michael E. LeClerc, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 277 days.

(21) Appl. No.: 16/452,074

(22) Filed: Jun. 25, 2019

(65) Prior Publication Data

US 2020/0141418 A1 May 7, 2020

Related U.S. Application Data

(60) Provisional application No. 62/756,859, filed on Nov. 7, 2018.

(51) Int. Cl.
*F04D 27/02* (2006.01)
*F04D 29/40* (2006.01)
(Continued)

(52) U.S. Cl.
CPC ..... *F04D 27/0269* (2013.01); *F04D 1/10* (2013.01); *F04D 29/326* (2013.01); *F04D 29/403* (2013.01)

(58) Field of Classification Search
CPC ..... F04D 27/0269; F04D 1/10; F04D 29/326; F04D 29/403; F04D 29/164;
(Continued)

(56) References Cited

U.S. PATENT DOCUMENTS 4,566,852 A * 1/1986 Hauser ..... B01D 53/005 123/41.49
7,789,622 B2 * 9/2010 Acre ..... F04D 29/526 415/209.3
(Continued)

FOREIGN PATENT DOCUMENTS

CN 1473244 A 2/2004
CN 1534188 A 10/2004
(Continued)

OTHER PUBLICATIONS

Chinese Office Action for Chinese Application No. 20191087520.6 dated May 17, 2021; 6 pgs.
(Continued)

*Primary Examiner* — Avinash A Savani
*Assistant Examiner* — Dana K Tighe
(74) *Attorney, Agent, or Firm* — Fletcher Yoder PC

(57) ABSTRACT

Systems and methods are provided for mitigating recirculation of backflow fluid through a fan. The fan includes a housing having a channel that extends from an inlet to an outlet of the housing. A rotor assembly is positioned within the channel and is configured to direct a fluid flow from the inlet to the outlet. The rotor assembly includes a hub, a plurality of fan blades, and a shroud disposed about a circumference of the fan blades, where a radial gap extends between the shroud and the housing. The radial gap is configured to receive a portion of the fluid flow from the outlet as backflow fluid. The rotor assembly also includes an inlet flange that is configured receive the backflow fluid
(Continued)

from the radial gap and to direct the backflow fluid in a direction away from the inlet prior to discharge of the backflow fluid from the radial gap.

20 Claims, 29 Drawing Sheets

(51) Int. Cl.
*F04D 1/10* (2006.01)
*F04D 29/32* (2006.01)

(58) Field of Classification Search
CPC .... F04D 29/667; F04D 29/522; F04D 29/541; F04D 29/661; F04D 25/166; F04D 19/002; H05K 7/20009; H05K 7/20136; H05K 7/20145; H05K 7/20172
USPC ..... 454/184
See application file for complete search history.

(56) References Cited

U.S. PATENT DOCUMENTS

| | | | | |
|---|---|---|---|---|
| 8,568,095 | B2 * | 10/2013 | Bushnell | F04D 29/164 415/228 |
| 9,234,521 | B2 | 1/2016 | Liu | |
| 9,334,877 | B2 * | 5/2016 | Nicholls | F04D 29/582 |
| 10,798,853 | B2 * | 10/2020 | Kwon | H02M 7/44 |
| 2003/0026699 | A1 | 2/2003 | Stairs et al. | |
| 2004/0191061 | A1 | 9/2004 | Jung et al. | |
| 2007/0071603 | A1 | 3/2007 | Takeuchi et al. | |
| 2010/0111667 | A1 | 5/2010 | Stagg et al. | |
| 2012/0195747 | A1 * | 8/2012 | Fukuda | F04D 29/4226 415/206 |
| 2015/0098817 | A1 | 4/2015 | Innocenti | |

FOREIGN PATENT DOCUMENTS

| | | | |
|---|---|---|---|
| CN | 1534199 | A | 10/2004 |
| CN | 1940307 | A | 4/2007 |
| CN | 101652563 | A | 2/2010 |
| CN | 101652573 | A | 2/2010 |
| CN | 202520644 | U | 11/2012 |
| CN | 203717442 | U | 7/2014 |
| CN | 104514737 | A | 4/2015 |
| CN | 207420962 | U | 5/2018 |
| JP | 2008151034 | A | 7/2008 |
| JP | 2018059416 | A | 4/2018 |
| JP | 4592906 | B2 | 12/2020 |

OTHER PUBLICATIONS

Chinese Office Action for Chinese Application No. 20191087520.6 dated Oct. 13, 2020; 6 pgs.

* cited by examiner

FAN FLOW DIRECTING FEATURES, SYSTEMS AND METHODS

CROSS-REFERENCE TO RELATED APPLICATIONS

This application claims priority from and the benefit of U.S. Provisional Application Ser. No. 62/756,859, entitled "FAN FLOW DIRECTING FEATURES, SYSTEMS AND METHODS", filed Nov. 7, 2018, which is hereby incorporated by reference in its entirety for all purposes.

BACKGROUND

The present disclosure relates generally to fans, such as those used for cooling electronics, and, more particularly, to flow directing features for mitigating a recirculation of backflow air through such fans.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

One or more fans (e.g., axial fans) are commonly included in various electronic devices such as, for example, computers (e.g., servers, desktop computers), or a variety of other stationary or portable electronic devices. The fans are typically used to direct a working fluid (e.g., air) through an enclosure of the electronic device and across certain components (e.g., a central processing unit, a power supply unit, a graphics processing unit) within the enclosure that may generate thermal energy (e.g., heat). Accordingly, the working fluid may absorb the generated thermal energy (e.g., via convective heat transfer) and transfer the thermal energy to an ambient environment (e.g., the atmosphere) surrounding the electronic device. In this manner, the fans may ensure that an operational temperature of components included in the electronic device remains below a target value or within a desired range.

In many cases, operation of the fan(s) may generate audible noise (e.g., acoustic energy) that propagates from the fans. Unfortunately, the generated noise may be unpleasant to a user operating the electronic device and/or other persons located in proximity to the fan(s).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to flow directing features for a fan (e.g., an axial fan) of an electronic device. In particular, the flow directing features discussed herein are configured to mitigate or substantially reduce the recirculation of backflow air within the fan and, thus, mitigate formation of flow structures that may disturb air flow upstream of fan blades of the fan. Flow disturbances of this sort may lead to the generation of broadband and tonal noise when interacting with the fan blades, as well as a reduction in net air flow through the fan. For example, typical fans generally include a rotor that is disposed within a channel of a fan housing and configured to rotate about a central axis of the channel. The rotor includes a plurality of fan blades that are configured to engage with a fluid (e.g., air) surrounding the fan and direct the air through the channel in an intended direction of air flow (e.g., a first flow direction). In certain cases, a shroud may be disposed about and coupled to the fan blades. Accordingly, the shroud may rotate with and form an outer perimeter of the rotor. A radial gap (e.g., a shroud gap) often extends between the shroud and a wall of the channel to enable unrestricted rotational motion of the rotor relative to the housing. In many cases, operation of the fan generates a pressure differential on opposing sides of the housing (e.g., a lower pressure at the inlet and a higher pressure at the outlet), which induces a backflow of air that flows through the radial gap in a direction opposite to the intended direction air flow through the housing. The backflow of air may discharge near an inlet of the housing and generate disturbances near the fan blades that may interact with the fan blades and disturb air flow through the fan. That is, a region of disturbed or non-uniform air flow may be created near and/or within the fan housing, which often generates unpleasant audible noise.

Accordingly, embodiments of the present disclosure are directed toward various flow directing features that may be included in the fan to mitigate (e.g., redirect) the recirculation of backflow air (e.g., high pressure air discharged from the radial gap) through the fan blades and/or block a discharge of the backflow air from the fan housing. By way of example, embodiments of the present disclosure include a rotating inlet flange (e.g., on the rotating shroud of the fan) that forms an upstream end portion of the fan (e.g., of the rotor) and guides backflow air discharging from the radial gap in a direction diverging away from an inlet of the fan. In this manner, the rotating inlet flange may reduce or substantially eliminate recirculation of backflow air through the housing of the fan. Embodiments of the present disclosure also include backflow mitigation feature(s) that extend radially from the rotating shroud of the rotor and project into the radial gap between the rotor and stationary housing. As described in detail below, these backflow mitigation features may increase an aerodynamic resistance (e.g., an aerodynamic impedance) or a static pressure within the radial gap to counter-act the pressure differential generated between the inlet and an outlet of the fan housing, thus mitigating air recirculation through the radial gap. As such, the backflow mitigation features may generate a stagnation of air within the radial gap that blocks a discharge of backflow air from the fan housing back to the inlet region of the fan. By employing the aforementioned techniques alone or in any combination, air flow disturbances resulting from the backflow of air may be inhibited from forming near and/or around the fan blades, thus reducing a magnitude of audible noise that may be generated during operation of the fan.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
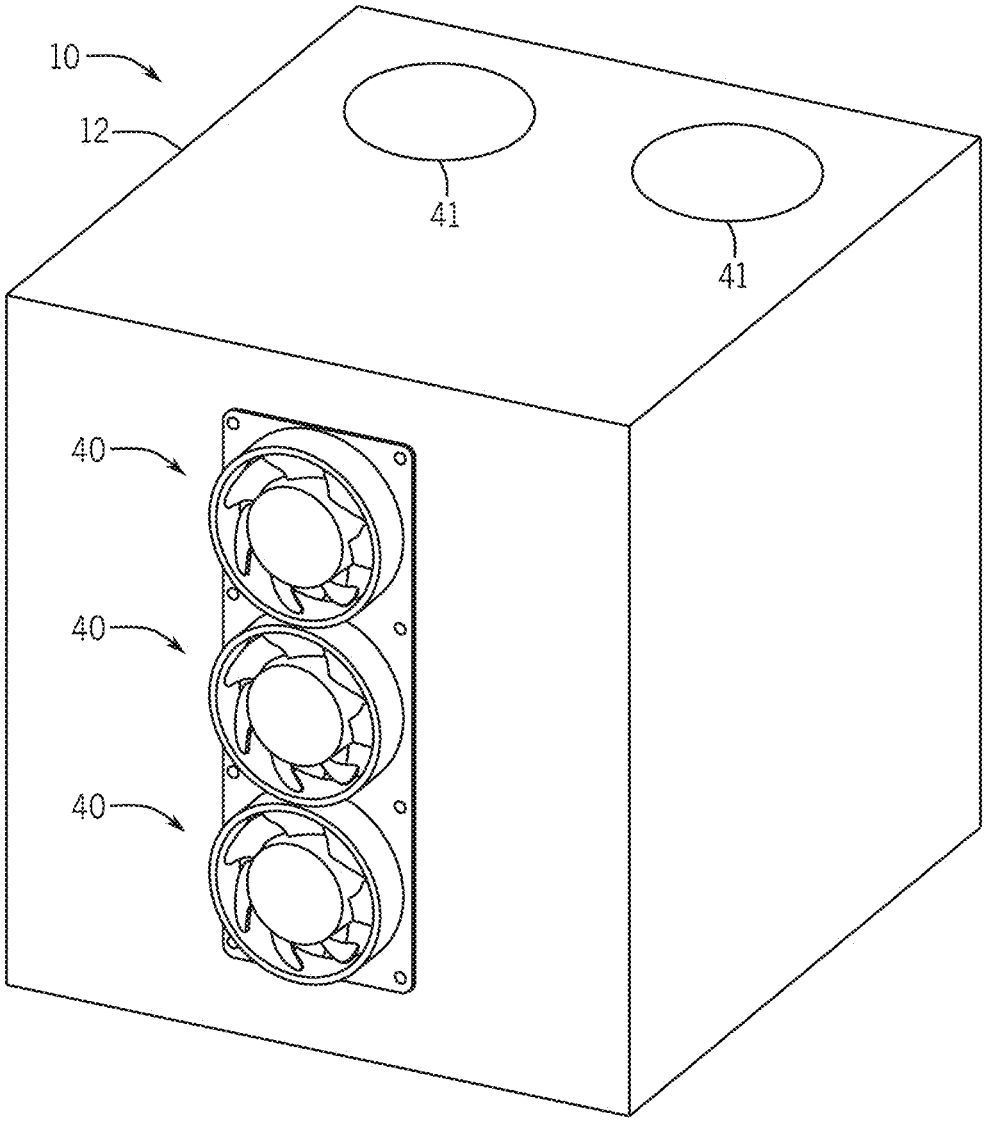
FIG. 1 is a front view an example of an electronic device having one or more fans, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, one or more flow generating devices (e.g., fans) are typically used to direct an air flow or other working fluid across certain components of an electronic device that may generate and release thermal energy. For example, a fan may be coupled to an enclosure of an electronic device and configured to circulate a continuous flow of cooling air through the enclosure, thereby preventing an accumulation of heated air within the enclosure. The fan typically includes a rotor disposed within a housing of the fan. The housing defines a channel (e.g., a flow path) along which air may flow through the housing. The rotor is configured to rotate about a central axis of the channel. Specifically, the rotor may include an electric motor or other suitable actuator that is configured to impart a torque on the rotor, thereby inducing rotation of the rotor relative to the housing of the fan. The rotor includes a hub having a plurality of angled fan blades extending radially therefrom. A circular shroud or ring may be disposed about and coupled to the fan blades, thereby forming an outer perimeter of the rotor. The fan blades engage with air surrounding the fan when the hub rotates, thereby forcing the air through the channel from an inlet to an outlet of the fan. In fans having a shrouded rotor, a radial gap extends between the rotating shroud and the housing to enable unobstructed rotation motion of the fan relative to the housing.

Operation of the fan generates a pressure differential between the inlet (e.g., low/ambient pressure) and the outlet (e.g., higher pressure) of the fan. This pressure differential may generate a backflow of air that flows through the radial gap between the rotating shroud and the housing from the outlet of the fan toward the inlet. In certain cases, this backflow air may be re-drawn into the inlet of the fan and disrupt air flow (e.g., cause fluidic disturbances to the air flow) around the fan blades. As noted above, this recirculation of backflow air through the fan may significantly increase audible noise that may be generated during operation of the fan.

Accordingly, the fan may be equipped with a rotating inlet flange that forms an upstream end portion (e.g., an inlet portion) of the rotor and directs backflow air in a direction away from the inlet. That is, the rotating inlet flange may include a contoured profile that redirects backflow air in a direction extending radially outward from the fan inlet as the backflow air is discharged from the housing. As such, the rotating inlet flange may enable the backflow air to discharge about a circumference of the housing in a direction away from the inlet, thereby reducing or substantially eliminating a likelihood of backflow air being drawn into the inlet of the fan. In some embodiments, a width of the radial gap between a terminal interface of the housing and the rotating inlet flange, referred to hereinafter as an axial gap or a vertical gap, may vary about a circumference of the housing. Width variations of the axial gap may be used to adjust a flow rate of backflow air discharging near certain portions of the housing. That is, a flowrate of backflow air may be biased toward particular side(s) (e.g., end portions) of the fan (e.g., or a fan array). As described in detail below, this flow biasing technique may reduce an amount of backflow air that may be transferred between fans disposed in close proximity to one another.

In certain embodiments, the fan may include a backflow mitigation feature, or multiple backflow mitigation features, that are included in the fan in addition to, or in lieu of, the rotating inlet flange. As discussed below, the backflow mitigation feature may reduce or substantially eliminate a backflow of air through the radial gap. For example, in some embodiments, the backflow mitigation feature may include a helical protrusion that extends from an outer surface the shroud and projects into the radial gap. Similar to the fan blades, the helical protrusion may engage the air within the radial gap and force the air in a flow direction toward the outlet of the fan. In some embodiments, the backflow mitigation feature may thereby generate a pressure within the radial gap that may partially or fully counter-act the pressure differential generated between the inlet and the outlet during operation of the fan. By reducing or mitigating the pressure difference from the fan outlet to the radial gap, air backflow into the radial gap may be mitigated or substantially prevented. In this manner, the backflow mitigation feature may mitigate a likelihood of air recirculation between the radial gap and the fan, thereby reducing audible noise that may be emitted by the disturbed air flow through the fan.

In further embodiments, one or more of the fan blades may be configured to protrude through the shroud of the fan to form a portion of, or all of, the backflow mitigation feature. That is, the fan blades may extend radially past the shroud and protrude into the radial gap, thereby engaging with the air within the radial gap and blocking (e.g., counteracting) a flow of backflow air in a similar manner as discussed above. These and other features will be described in detail below with reference to the drawings.

With the foregoing in mind, FIG. 1 is a schematic diagram of an embodiment of an electronic device 10 that may include the features of the present disclosure. The electronic device 10 may take the form of a computer (e.g., a server), a portable electronic device, or any other suitable type of electronic device. Such computers may include computers that are generally portable (e.g., laptops, notebooks, and tablet computers) as well as computers that are generally used in one place (e.g., conventional desktop computers, workstations, and/or servers). By way of example, the depicted electronic device 10 may include a housing or an enclosure 12 having certain electrical components of the electronic device 10 disposed therein. The electronic device 10 may include one or more fans 40, which are coupled to the enclosure 12 and operable to direct a flow of working fluid (e.g., air) across certain components within the enclosure 12. For example, the fans 40 may be configured to direct a flow of ambient atmospheric air across a central processing unit (CPU) of the electronic device 10, such that the air may absorb thermal energy (e.g., via convective heat transfer) from the CPU. The fans 40 may discharge the heated air through one or more outlets 41 of the enclosure 12. In this manner, the fans 40 may ensure that an operational temperature of the CPU, or a temperature of any other component within the enclosure 12, remains below a target value or within a desired range.

Figure 2:
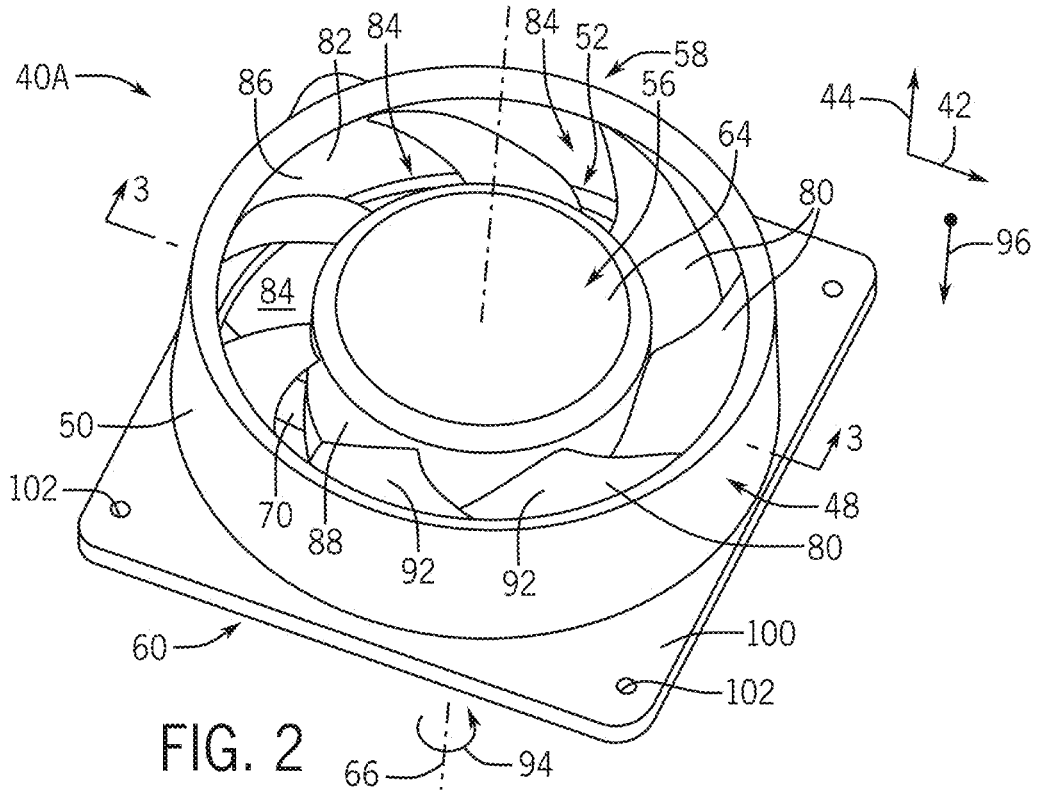
FIG. 2 is a perspective view of an example of a fan that may be included in the electronic device of FIG. 1, in accordance with an embodiment of the present disclosure.

With the preceding in mind, FIG. 2 is a perspective view of an embodiment of one of the fans 40A. To facilitate discussion, the fan 40A and its components will be described with reference to a radial axis 42 and a vertical axis 44. The fan 40A includes a housing 48, which includes an outer wall 50 that forms a channel 52 extending through the housing 48. The channel 52 extends along the vertical axis 44 and defines a flow path for a fluid, such as air, which may flow through the housing 48 via the channel 52. A rotor assembly 56 is disposed within the channel 52 and configured to force air along the flow path from an inlet 58 of the housing 48 (e.g., a first end portion of the housing 48, an inlet of the channel 52) to an outlet 60 of the housing 48 (e.g., a second end portion of the housing 48, an outlet of the channel 52).

Figure 3:
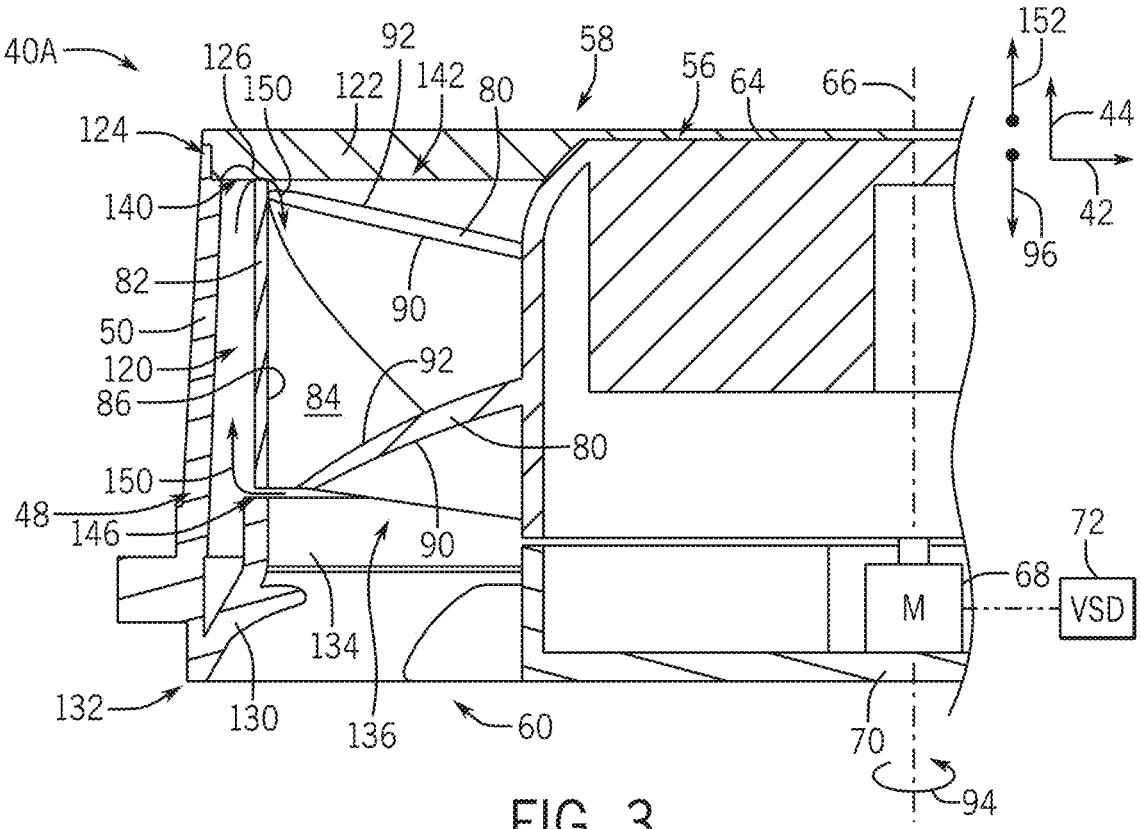
FIG. 3 is a partial cross-sectional view of an example of the fan of FIG. 2, in accordance with an embodiment of the present disclosure.

For example, the rotor assembly 56 may include a hub 64 that is configured to rotate about the vertical axis 44 or a centerline 66 (e.g., a central axis) of the channel 52. That is, the hub 64 may be coupled to a motor 68, as shown in FIG. 3, which is configured to rotate the hub 64 relative to the housing 48. The motor 68 is coupled to a portion 70 of the housing 48, such that rotational motion of the motor 68 relative to the housing 48 is blocked. Accordingly, the motor 68 may apply a torque to the hub 64 and thus impart rotational motion to the rotor assembly 56. The motor 68 may include any suitable electric motor or actuator that can be powered directly from an alternating current (AC) or direct current (DC) power source. As an example, the motor 68 may include a switched reluctance motor, an induction motor, an electronically commutated permanent magnet motor, or another suitable motor. In some embodiments, the motor 68 is electrically coupled to a variable speed drive (VSD) 72, as shown in FIG. 3, which may be configured to supply electrical energy to the motor 68 at a particular voltage, current, and/or frequency. Accordingly, the VSD 72 may be used to dynamically adjust an operational speed (e.g., between 500 and 3500 RPM) of the motor 68, and thus, increase or decrease a rotational speed of the hub 64.

As shown in the illustrated embodiment of FIG. 2, the rotor assembly 56 includes a plurality of fan blades 80 that extend radially from the hub 64 and couple to a shroud 82 disposed about a circumference of the fan blades 80. Accordingly, the fan blades 80 define a plurality of fluid passages 84 that extend between an interior surface 86 of the shroud 82 and an exterior surface 88 of the hub 64. By way of example, in certain embodiments, the rotor assembly 56 may include an outer diameter between about 50 millimeters (mm) and about 200 mm. However, in other embodiments, the rotor assembly 56 may include an outer diameter that is less than 50 mm or greater than 200 mm. Although the hub 64 includes 7 fan blades 80 in the illustrated embodiment of FIG. 2, it should be noted that in other embodiments, the rotor assembly 56 may include any suitable quantity of fan blades 80 extending from the hub 64. That is, the rotor assembly 56 may include 2, 3, 4, 5, 6, 7, 8, or more fan blades 80.

Each of the fan blades 80 includes a pressure surface 90, as shown in FIG. 3, which is oriented toward an intended direction of air flow through the channel 52, and a suction surface 92 disposed opposite the pressure surface 90. The pressure surface 90 engages with air surrounding the rotor assembly 56 when the rotor assembly 56 rotates about the centerline 66, such that the pressure surface 90 may direct the air through the channel 52 of the fan 40A. For example, the motor 68 may be configured to rotate the rotor assembly 56 counter-clockwise direction 94 about the centerline 66, thereby enabling the fan blades 80 to generate an air flow through the channel 52 in a first direction 96 from the inlet 58 to the outlet 60 of the housing 48.

In some embodiments, the housing 48 may include a mounting flange 100 that extends from the outer wall 50 and enables the fan 40A to couple to a suitable portion of the enclosure 12. For example, the mounting flange 100 may include one or more apertures 102 defined therein, which enable fasteners to extend through the mounting flange 100 and facilitate coupling the fan 40A the enclosure 12. Accordingly, the fan 40A may be used to circulate an air flow through the enclosure 12 (e.g., via an inlet and outlet of the enclosure 12) to remove thermal energy from certain components of the electronic device 10 that may generate heat, as noted above. Although the mounting flange 100 extends from the outer wall 50 near the outlet 60 of the housing 48 in the illustrated embodiment, it should be noted that the mounting flange 100 may be situated near any other portion of the housing 48 (e.g., near the inlet 58) in other embodiments of the fan 40A.

FIG. 3 is a partial cross-sectional view of the fan 40A taken along line 3-3 of FIG. 2. As shown in the illustrated embodiment, a radial gap 120 (e.g., a shroud gap) extends between the inner surface of the outer wall 50 and the outer surface of the shroud 82. The radial gap 120 may preclude physical contact between the outer wall 50 and the shroud 82 to ensure that the housing 48 does not inhibit rotational motion of the rotor assembly 56. The fan 40A includes an inlet flange 122 that is coupled to a first end portion 124 of the outer wall 50, proximate the inlet 58. The inlet flange 122 may extend radially inward (e.g., toward the centerline 66) and span across the radial gap 120. For example, in some embodiments, an inner diameter of the inlet flange 122 (e.g., a diameter at a tip 126 of the inlet flange 122) may be substantially equal to an inner diameter of the shroud 82 (e.g., a diameter extending across the interior surface 86 of the shroud 82). In this manner, the inlet flange 122 may facilitate guiding air into the fluid passages 84 extending between the fan blades 80.

In some embodiments, the housing 48 includes an inner wall 130 that extends from a second end portion 132 of the outer wall 50 toward the rotor assembly 56. The inner wall 130 may form an outlet ring 134 that is disposed proximate a downstream end portion 136 of the shroud 82. Similar to the inlet flange 122 discussed above, an inner diameter of the outlet ring 134 may be substantially equal to the inner diameter of the shroud 82. Accordingly, the inner wall 130 may guide air discharging from the fluid passages 84 toward the outlet 60 of the housing 48.

It is important to note that vertical gaps extend between the inlet flange 122 and the shroud 82, and the shroud 82 and the outlet ring 134, respectively. That is, a first vertical gap 140 extends between the inlet flange 122 and an upstream end portion 142 of the shroud 82, and a second vertical gap 146 extends between the downstream end portion 136 of the shroud 82 and the inner wall 130. As with the radial gap 120, the first and second vertical gaps 140, 146 may ensure that physical contact between the shroud 82, the inlet flange 122, and the inner wall 130 is precluded, thereby enabling the rotor assembly 56 to rotate freely within the housing 48. As a non-limiting example, in some embodiments, a width of the first vertical gap 140, a width of the second vertical gap 146, or both, may be between about 0.5 mm and about 2 mm.

As noted above, operation of the fan 40A may generate a region of high pressure air proximate the outlet 60 of the housing 48 and a region of low pressure air proximate the inlet 58 of the housing 48. In other words, an air pressure near the outlet 60 may be greater than an air pressure near the inlet 58. This pressure differential may generate a secondary air flow, or a backflow of air (e.g., as indicated by arrow 150), which enters the radial gap 120 via the second vertical gap 146 and flows through the radial gap 120 toward the inlet 58. That is, the backflow of air may flow in a second direction 152, which is generally opposite to the first direction 96 of air flow along the fluid passages 84 of the fan blades 80. The backflow of air may discharge from the radial gap 120 via the first vertical gap 140 and re-enter the fluid passages 84. As such, a portion of the air flowing through the channel 52 may be recirculated about a perimeter of the shroud 82.

Unfortunately, this stream of air circulating through the radial gap 120 may disturb a flow of mainstream air entering the inlet 58 (e.g., increase turbulence of the air flow entering the inlet 58), thereby generating and/or increasing audible aero-acoustic noise (e.g., acoustic energy) that may be unpleasant to users operating the electronic device 10. As discussed in detail below, this audible noise may be particularly prominent within certain harmonic frequency ranges of the fan 40A. Accordingly, embodiments of the present disclosure are directed toward a rotating inlet flange that is configured to reduce or substantially eliminate a recirculation of backflow air through the radial gap 120 and the fluid passages 84 of the rotor assembly 56. As such, the rotating inlet flange may lower a magnitude (e.g., a decibel level) of audible tonal (e.g., harmonic) noise that may be generated during operation of the fan 40A.

Figure 4:
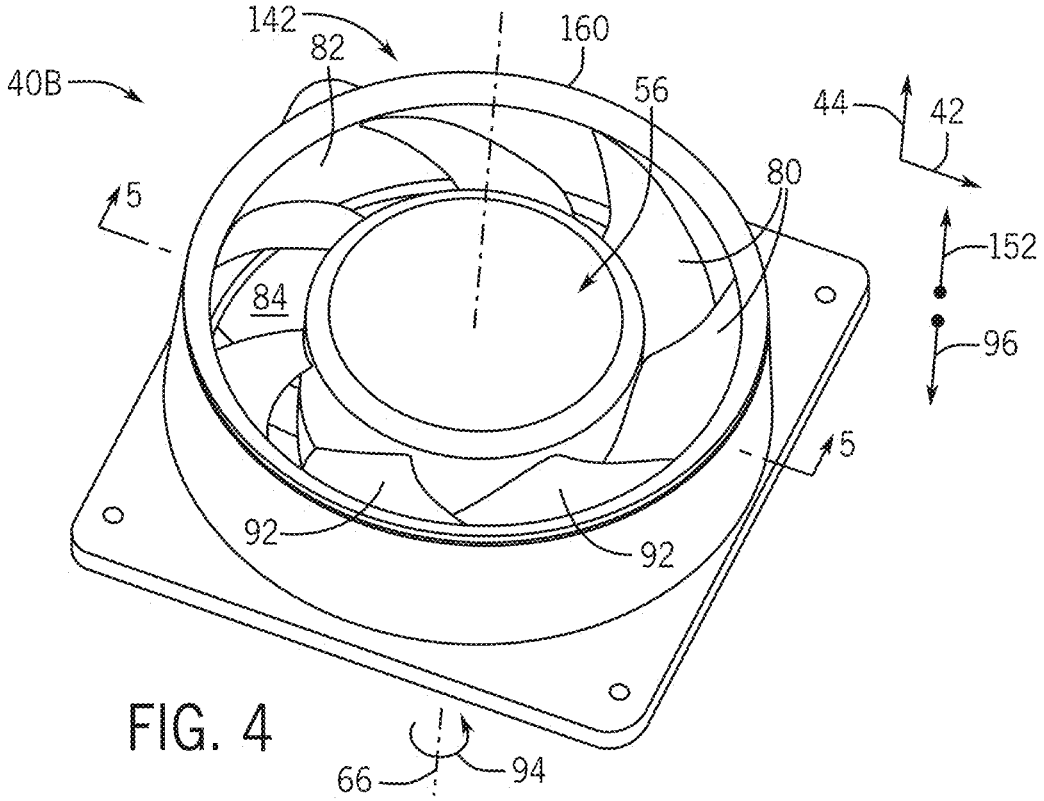
FIG. 4 is a perspective view of an example of a fan having a rotating inlet flange, in accordance with an embodiment of the present disclosure.

With the preceding in mind, FIG. 4 is a perspective view of an embodiment of the fan 40B having a rotating inlet flange 160 (e.g., an angled inlet flange). As noted above, the rotating inlet flange 160 is configured to reduce or substantially eliminate a likelihood of air recirculation about the shroud 82 during operation of the fan 40B. The rotating inlet flange 160 may be formed integrally with the rotor assembly 56 (e.g., via an injection molding process), or may couple to the rotor assembly 56 via suitable fasteners or adhesives (e.g., bonding glue). In the present example the rotating inlet flange 160 is formed integrally with shroud 82, such that the rotating inlet flange 160 forms a portion (e.g., the upstream end portion 142) of the shroud 82.

Figure 5:
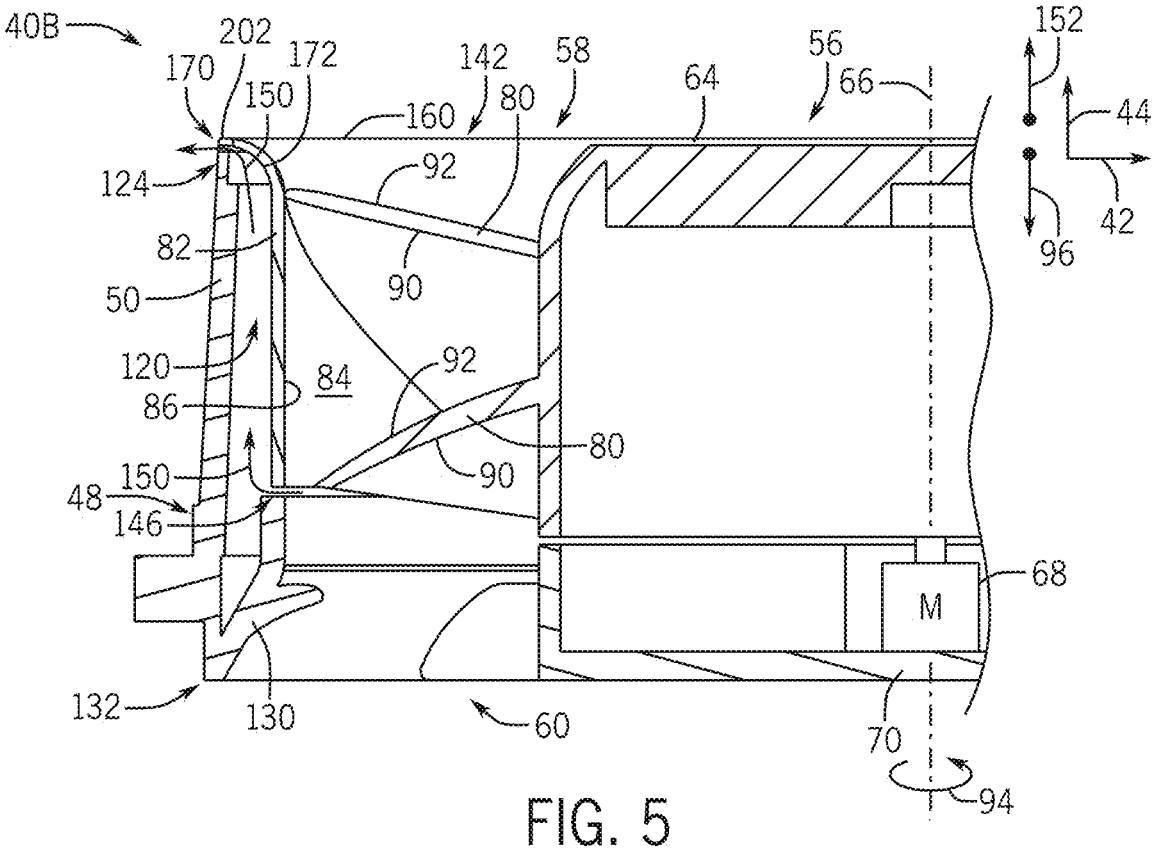
FIG. 5 is a partial cross-sectional view of an example of the fan of FIG. 4, in accordance with an embodiment of the present disclosure.

To facilitate the subsequent discussion, FIG. 5 depicts a partial cross-sectional view of the fan 40B taken along line 5-5 of FIG. 4. As shown in the illustrated embodiment of FIG. 5, the rotating inlet flange 160 extends from a generally cylindrical section of the shroud 82 and defines a gap, referred to herein as a vertical gap 170, which extends between the first end portion 124 of the outer wall 50 and a lower circumferential edge of the rotating inlet flange 160.

It is important to note that the rotating inlet flange 160 includes a profile 172 (e.g., a curved profile) that diverges radially from the generally cylindrical section of the shroud 82 to an outer edge (e.g., a distal end) of the rotating inlet flange 160. Accordingly, air flowing through the radial gap 120 may be guided along the profile 172 of the rotating inlet flange 160 prior to discharging from the housing 48. As such, the profile 172 may redirect air discharging from the radial gap 120 generally along the radial axis 42, away from the centerline 66 of the channel 52. That is, the backflow air discharges from the radial gap 120 in a direction diverging from the centerline 66. In this manner, the rotating inlet flange 160 may mitigate a likelihood of the fan 40B re-ingesting backflow air via the rotor assembly 56, thereby reducing or substantially eliminating air recirculation between the radial gap 120 and the fluid passages 84. As such, the rotating inlet flange 160 may significantly reduce audible noise that may be generated during operation of the rotor assembly 56.

Figure 6:
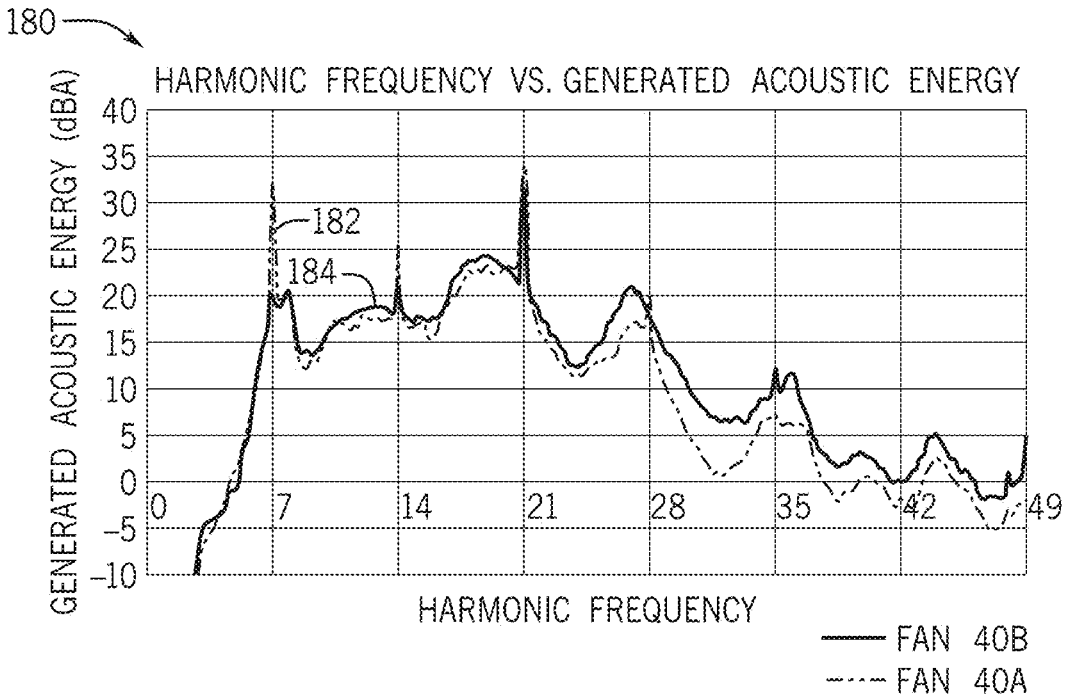
FIG. 6 is an example of a graph illustrating a magnitude of acoustic energy that may be generated by the fans of FIGS. 2 and 4.

For example, FIG. 6 is an embodiment of a graph 180 illustrating a magnitude of acoustic energy (e.g., in decibels) that may be generated at a particular operational speed (e.g., in revolutions per minutes) of the fans 40A, 40B for various harmonic frequencies of the fans 40A, 40B. A fundamental harmonic frequency of the fans 40A, 40B may be indicative of a calculable blade pass frequency (BPF) of the fans 40A, 40B. Equation I (EQ I) below illustrates an embodiment of the analytical relationship that may be used to determine the blade pass frequency, BPF, given the rotational speed of the fans 40A, 40B in revolutions per minute, N, and the quantity of fan blades 80 included in the rotor assembly 56, k.

$$BPF = \frac{Nk}{60} \quad \text{(EQ 1)}$$

Accordingly, sequential harmonic frequencies of the fans 40A, 40B may be determined by calculating multiples of the blade pass frequency (e.g., multiples of the fundamental harmonic frequency). With the foregoing in mind, the graph 180 illustrates a magnitude of acoustic energy that may be generated by the fans 40A, 40B at various harmonic frequencies. In particular, line 182 illustrates acoustic energy that may generated by the fan 40A, while line 184 illustrates acoustic energy that may be generated by the fan 40B.

As shown in the graph 180 of FIG. 6, the fan 40A may generate significantly more acoustic energy at the first through fourth harmonic frequencies as compared to a magnitude of acoustic energy that may be generated by the fan 40B at these frequencies. Specifically, the fan 40A may generate spikes in acoustic energy at multiples of the blade pass frequency of the fan 40A (e.g., at the first four harmonic frequencies). These spikes in acoustic energy may be amplified by the recirculation of backflow air through the fan 40A, and may be prominently audible (e.g., of a higher magnitude of acoustic energy) over remaining acoustic energy generated by the fan 40A (e.g., acoustic energy that may be generated via operation of the motor 68). In other words, although many aspects of the fans 40A, 40B make noise, such as the air flow generated by the fans 40A, 40B, the noise of the motors, etc., the noise spikes generated at harmonics of the BPF due to the recirculation of backflow air in the fan 40A are quite noticeable to users as compared to the other fan noise. Conversely, as shown in the graph 180, the fan 40B may not generate distinguishable spikes in acoustic energy, except at the third harmonic frequency in this example, because the rotating inlet flange 160 mitigates recirculation of backflow air into the inlet 58 of the fan 40B. Accordingly, the BPF noise due to recirculation of the backflow air in the fan 40B is much less prominent comparatively.

Figure 7:
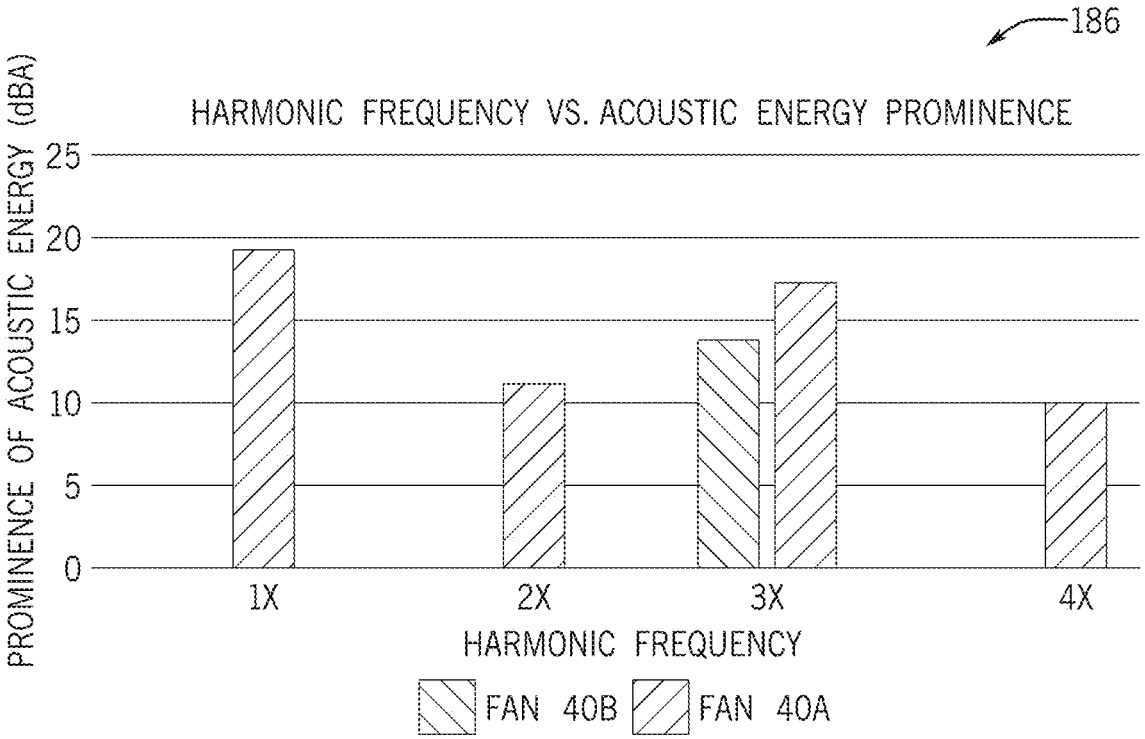
FIG. 7 is an example of a chart illustrating a prominence of acoustic energy at harmonics of the blade-passing frequency that may be generated by the fans of FIGS. 2 and 4.

FIG. 7 is an embodiment of a chart 186 illustrating a prominence of acoustic energy that may be generated by at the first four BPF harmonic frequencies of the fans 40A,40B due to the recirculation of backflow air through the fans 40A, 40B. In other words, FIG. 7 illustrates a prominence of tonal acoustic energy (e.g., audible tonal noise) that may be generated in part by the recirculation of backflow air, which may be separately discernable (e.g., of higher magnitude) from remaining acoustic energy that may be generated by the fans 40A, 40B (e.g., acoustic energy that may be generated by motor 68, airflow through the fans, etc.). As shown in the illustrated embodiment of the chart 186, the fan 40A may generate significant acoustic energy at the first four harmonic frequencies of the fan 40A due to the recirculation of backflow air through the fan 40A. In contrast, the rotating inlet flange 160 of the fan 40B may substantially mitigate noticeable audible noise that may be generated at the first, the second, and the fourth harmonic frequencies, as the rotating inlet flange 160 may mitigate recirculation of backflow air through the fan 40B (e.g., the prominence of acoustic energy generated due to backflow air recirculation may be substantially negligible at the first, the second, and the third harmonic frequencies of the fan 40B). Although the fan 40B may generate discernable acoustic energy due to backflow air recirculation at the third harmonic frequency, a magnitude of this acoustic energy is less than a magnitude of the acoustic energy that may be generated by the fan 40A (e.g., due to backflow air recirculation).

Figure 8:
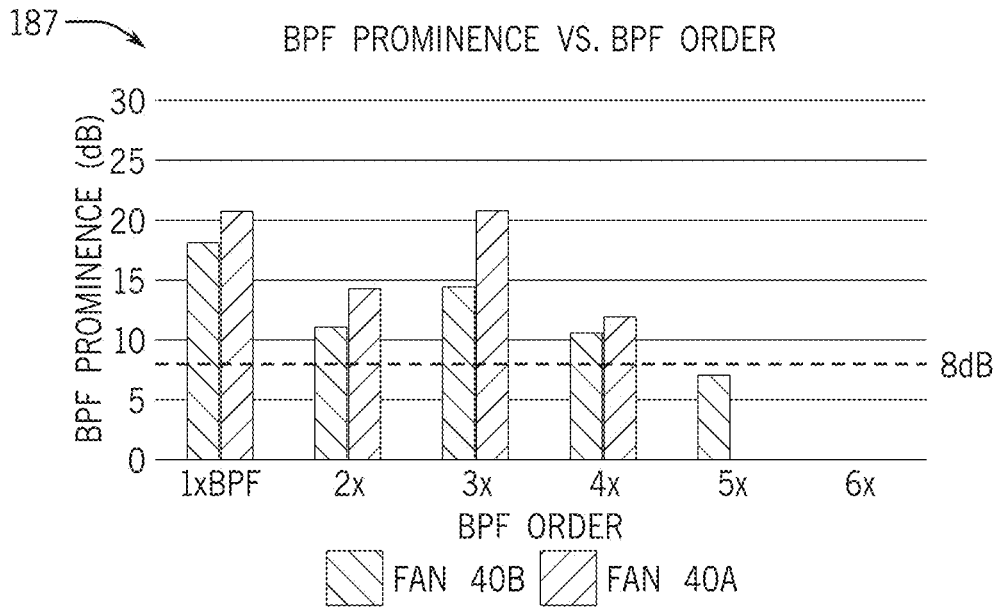
FIG. 8 is an example of a chart illustrating a prominence of acoustic energy at harmonics of the blade-passing frequency that may be generated by the fans of FIGS. 2 and 4.

As another example, FIG. 8 is an embodiment of a chart 187 that illustrates a prominence of acoustic energy (e.g., in decibels) that may be generated by air flow through the fan 40A and the fan 40B at various blade pass frequency orders (e.g., at various harmonic frequencies) when the fans 40A, 40B operate at a different operational speed than the operational speed of the fans 40A, 40B in FIG. 7.

Figure 9:
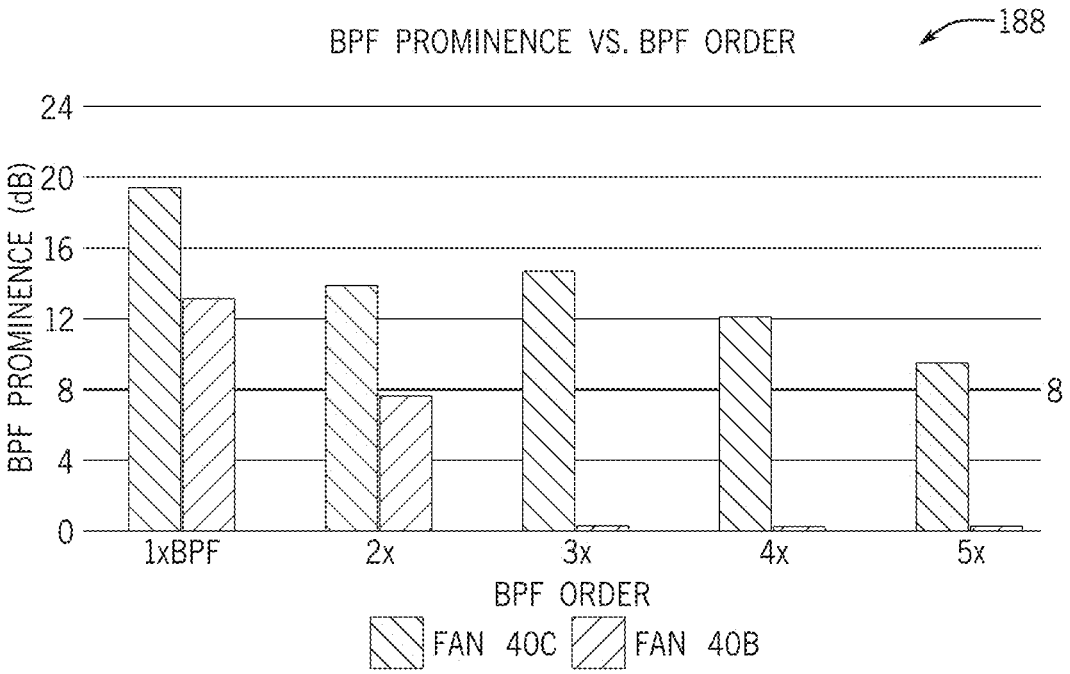
FIG. 9 is an example of a chart illustrating a prominence of acoustic energy at harmonics of the blade-passing frequency that may be generated by a shroudless fan and the fan of FIG. 4.
Figure 10:
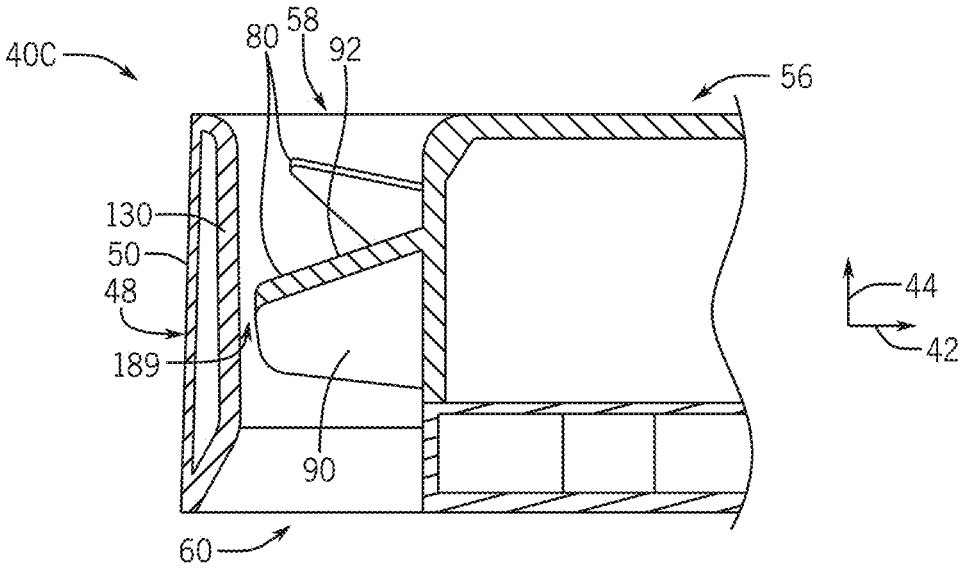
FIG. 10 is a partial cross-sectional view of an example of a shroudless fan, in accordance with an embodiment of the present disclosure.
Figure 11:
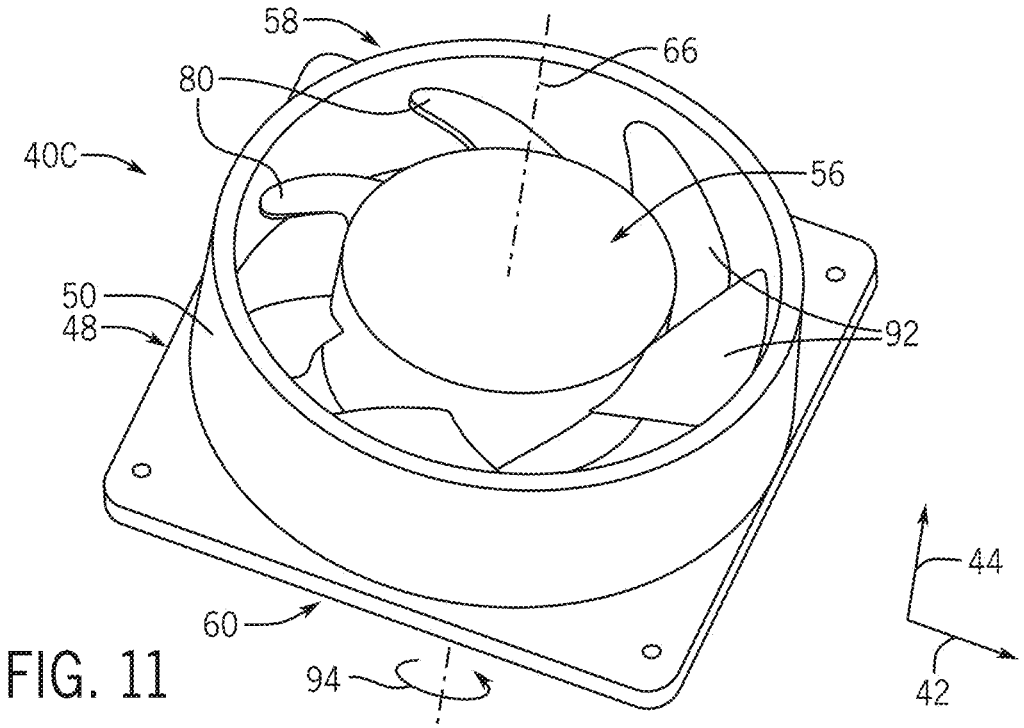
FIG. 11 is a perspective view of an example of the shroudless fan of FIG. 10, in accordance with an embodiment of the present disclosure.

FIG. 9 is an embodiment of a chart 188 illustrating a prominence of acoustic energy that may be generated by air flow through a shroudless fan 40C, as shown in the illustrated embodiments of FIGS. 10 and 11, and air flow through the fan 40B, for the first five blade pass frequency harmonics of the fans 40B, 40C at a particular operational speed of the fans 40B, 40C. As shown in the illustrated embodiment of FIG. 10, a tip gap 189 extends between tips of the fan blades 80 (e.g., radially outermost points of the fan blades 80) and the inner wall 130 of the housing 48, such that the rotor assembly 56 may rotate freely within the housing 48. In shroudless fans (e.g., the shroudless fan 40C), tip leakage vortices often form around the tips of the fan blades 80, thereby generating undesirable aero-acoustic noise (e.g., acoustic energy) that may propagate from the shroudless fans 40C. For example, relatively high pressure air near the pressure surface 90 of the fan blades 80 may flow (e.g., leak) through the tip gap 189 to a region of relatively low pressure air near the suction surface 92 of the fan blades 80, thereby forming the tip leakage vortices around the blade tips of the fan blades 80. As discussed in detail below, the shroud 82 may block air flow around the tips of the fan blades 80 from the pressure surface 90 to the suction surface 92 and, thus, substantially eliminate acoustic energy that may be generated due to the formation of tip leakage vortices within the housing 48.

Figure 12:
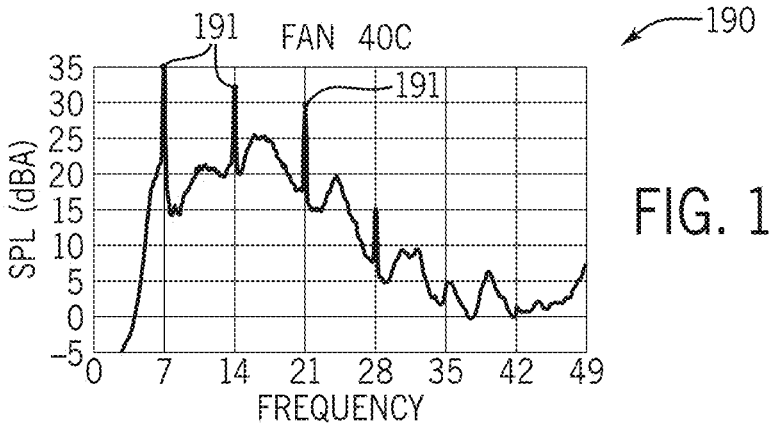
FIG. 12 is an example of a graph illustrating a magnitude of acoustic energy that may be generated by the fan of FIG. 10, in accordance with an embodiment of the present disclosure.

FIG. 12 is an embodiment of a graph 190 illustrating a magnitude of acoustic energy that may be generated by the shroudless fan 40C at various frequencies for a particular operational speed (e.g., in revolutions per minute) of the shroudless fan 40C. As shown in the graph 190, the shroudless fan 40C may generate spikes 191 of acoustic energy that occur at particular frequencies (e.g., multiples of the blade pass frequency of the shroudless fan 40C).

Figure 13:
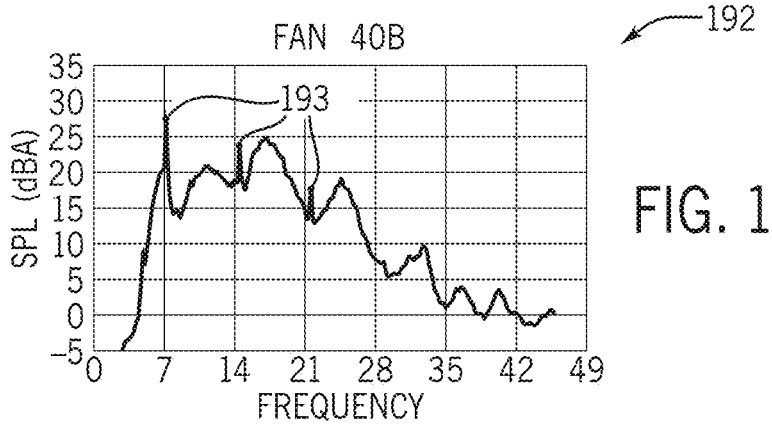
FIG. 13 is an example of a graph illustrating a magnitude of acoustic energy that may be generated by the fan of FIG. 4, in accordance with an embodiment of the present disclosure.
Figure 14:
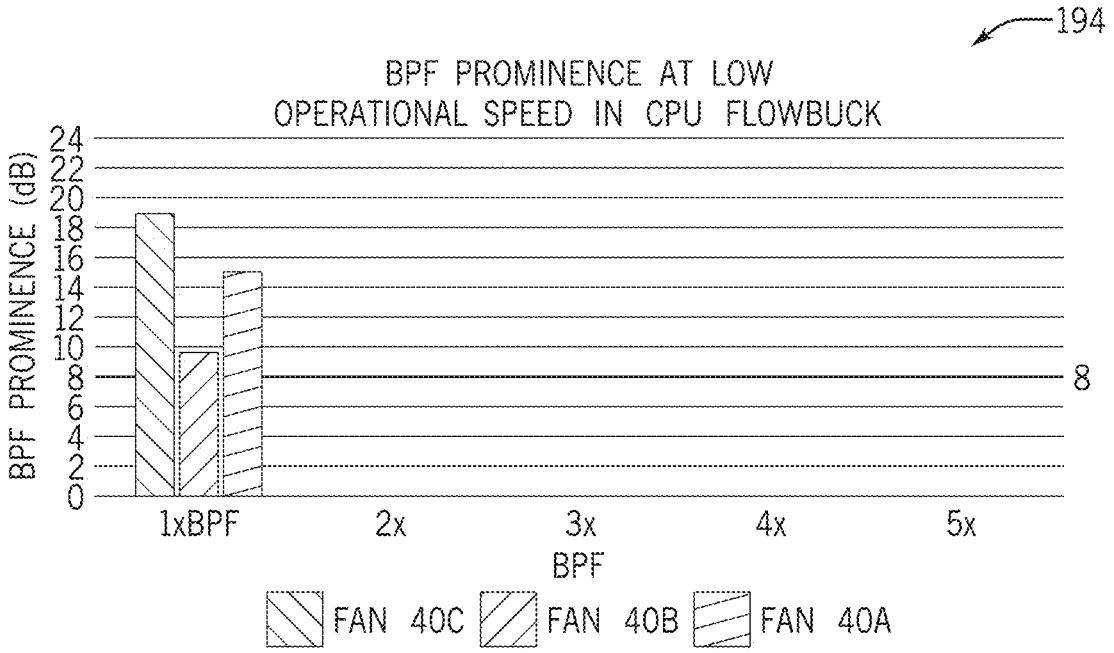
FIG. 14 is an example of a chart illustrating a magnitude of the prominence of blade pass frequency acoustic energy that may be generated for various fans, in accordance with an embodiment of the present disclosure.
Figure 15:
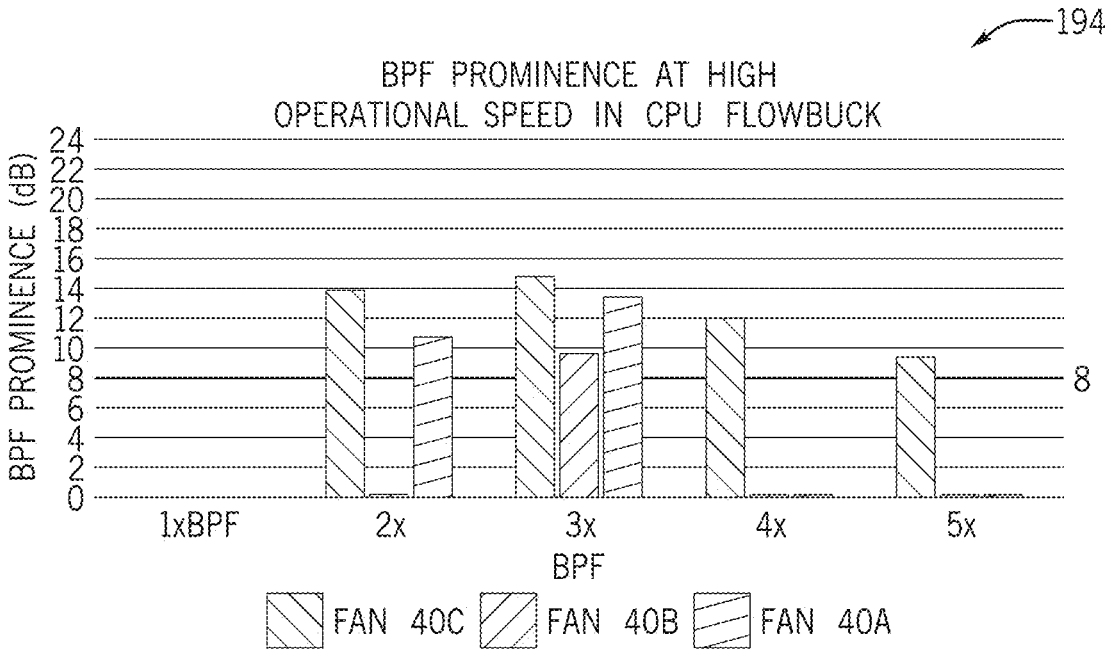
FIG. 15 is an example of a chart illustrating a magnitude of the prominence of blade pass frequency acoustic energy that may be generated for various fans, in accordance with an embodiment of the present disclosure.
Figure 16:
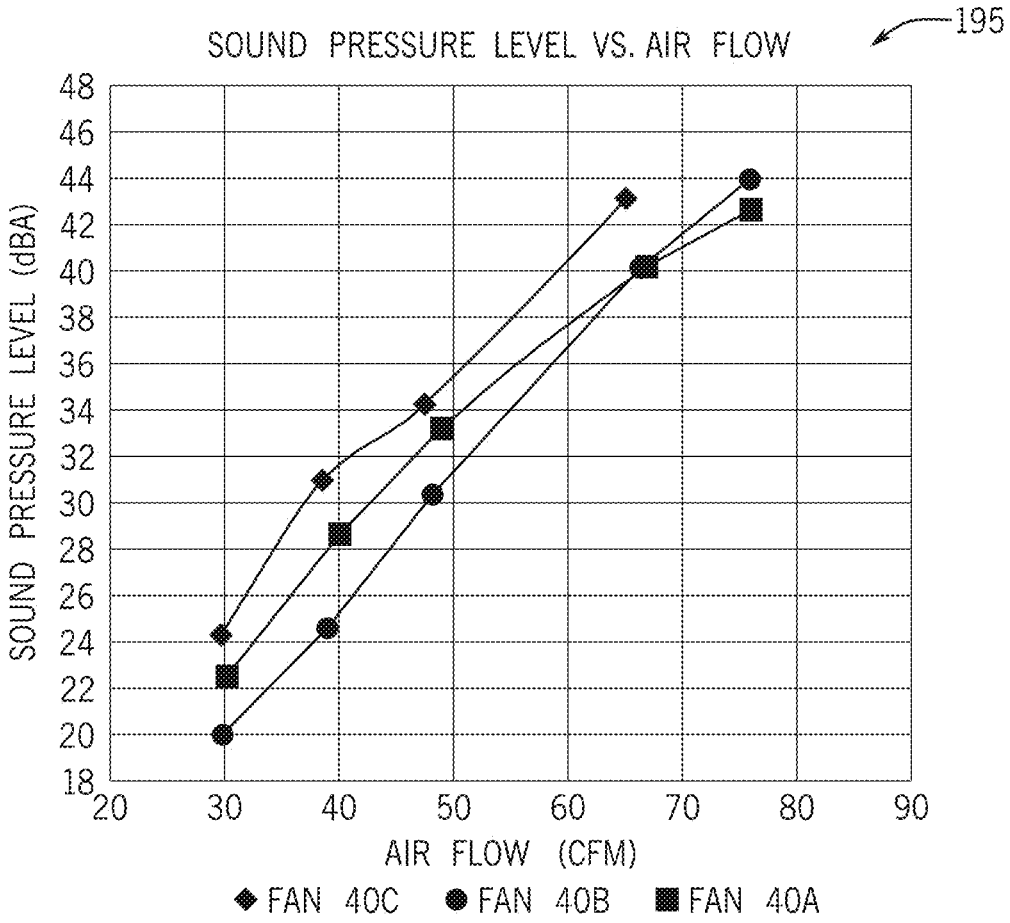
FIG. 16 is an example of a graph illustrating a correlation between a produced air flow rate and a magnitude of generated acoustic energy for various fans, in accordance with an embodiment of the present disclosure.
Figure 17:
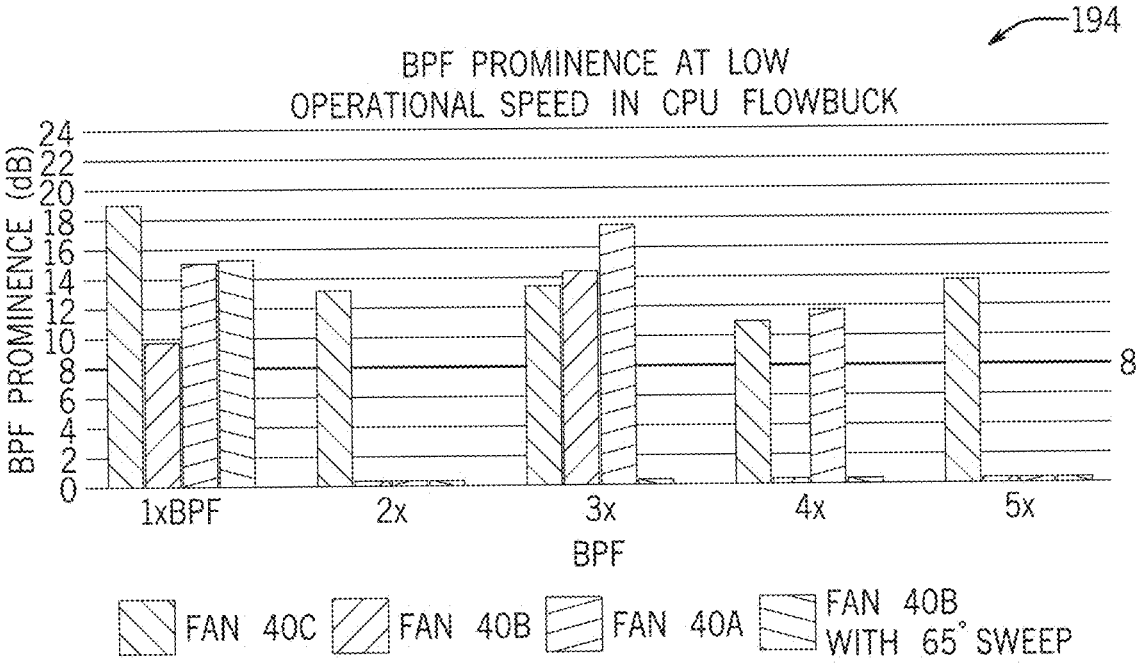
FIG. 17 is an example of a chart illustrating a magnitude of the prominence of blade pass frequency acoustic energy that may be generated for various fans, in accordance with an embodiment of the present disclosure.
Figure 18:
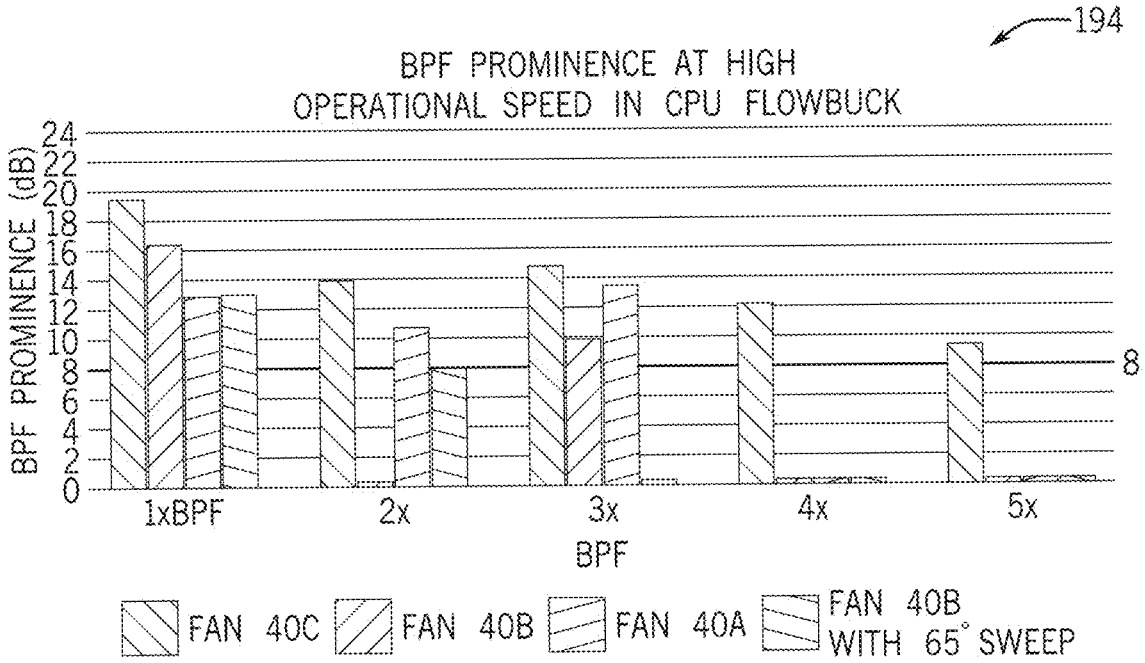
FIG. 18 is an example of a chart illustrating a magnitude of the prominence of blade pass frequency acoustic energy that may be generated for various fans, in accordance with an embodiment of the present disclosure.
Figure 19:
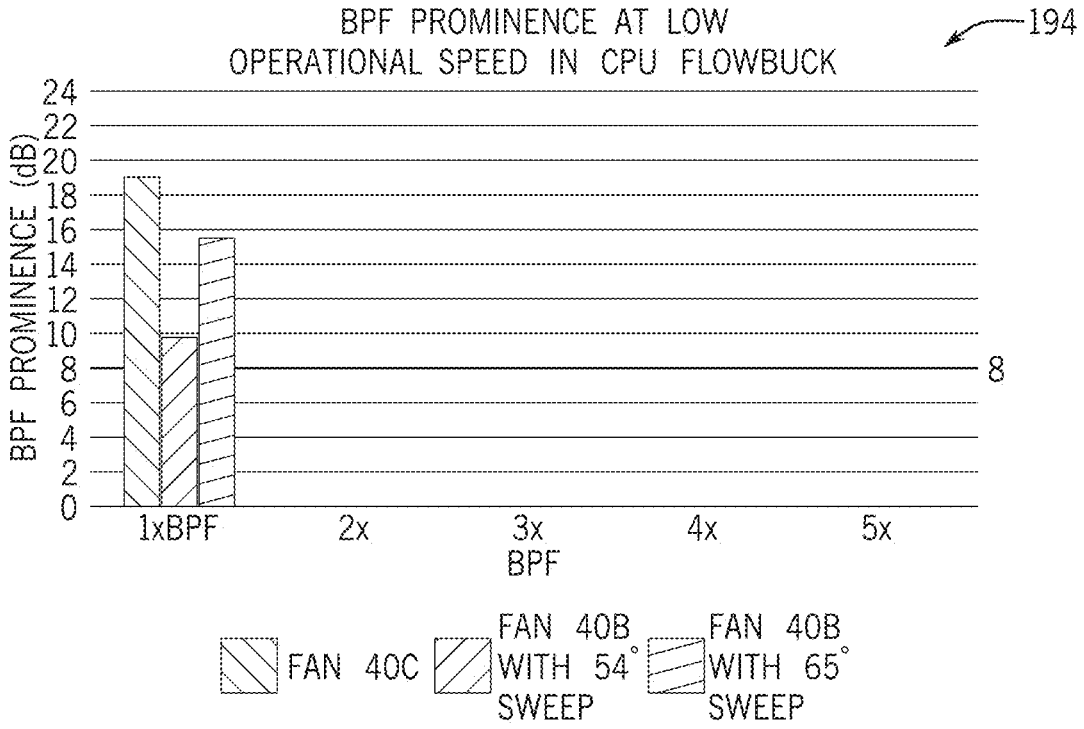
FIG. 19 is an example of a chart illustrating a magnitude of the prominence of blade pass frequency acoustic energy that may be generated for various fans with different blade angles, in accordance with an embodiment of the present disclosure.
Figure 20:
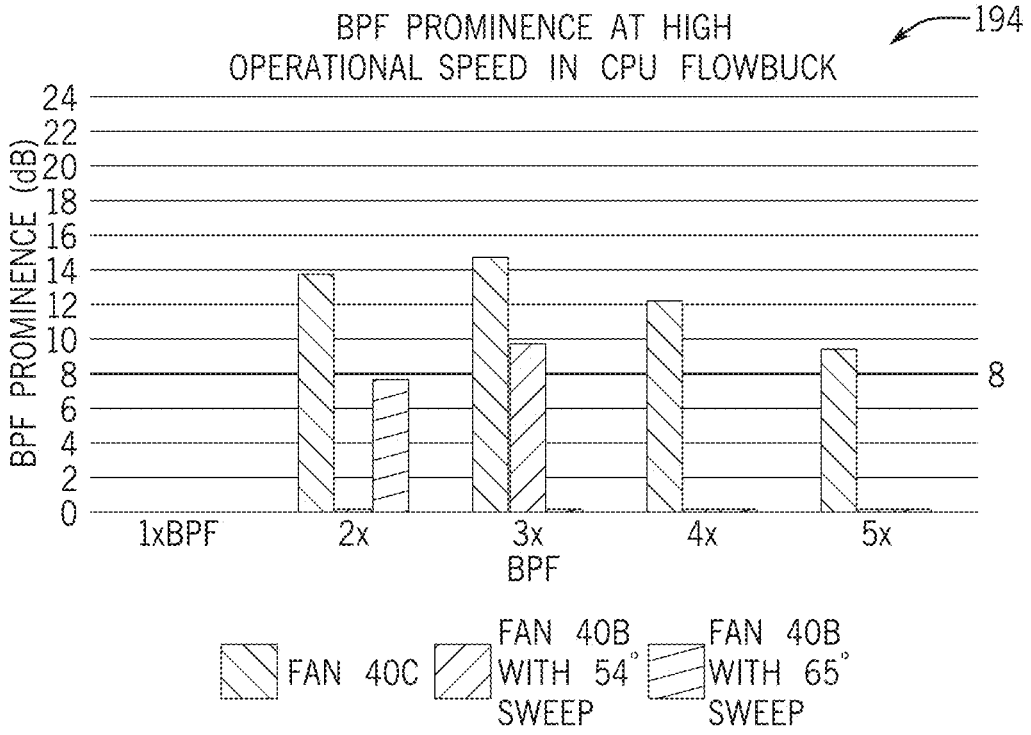
FIG. 20 is an example of a chart illustrating a magnitude of the prominence of blade pass frequency acoustic energy that may be generated for various fans with different blade angles, in accordance with an embodiment of the present disclosure.
Figure 21:
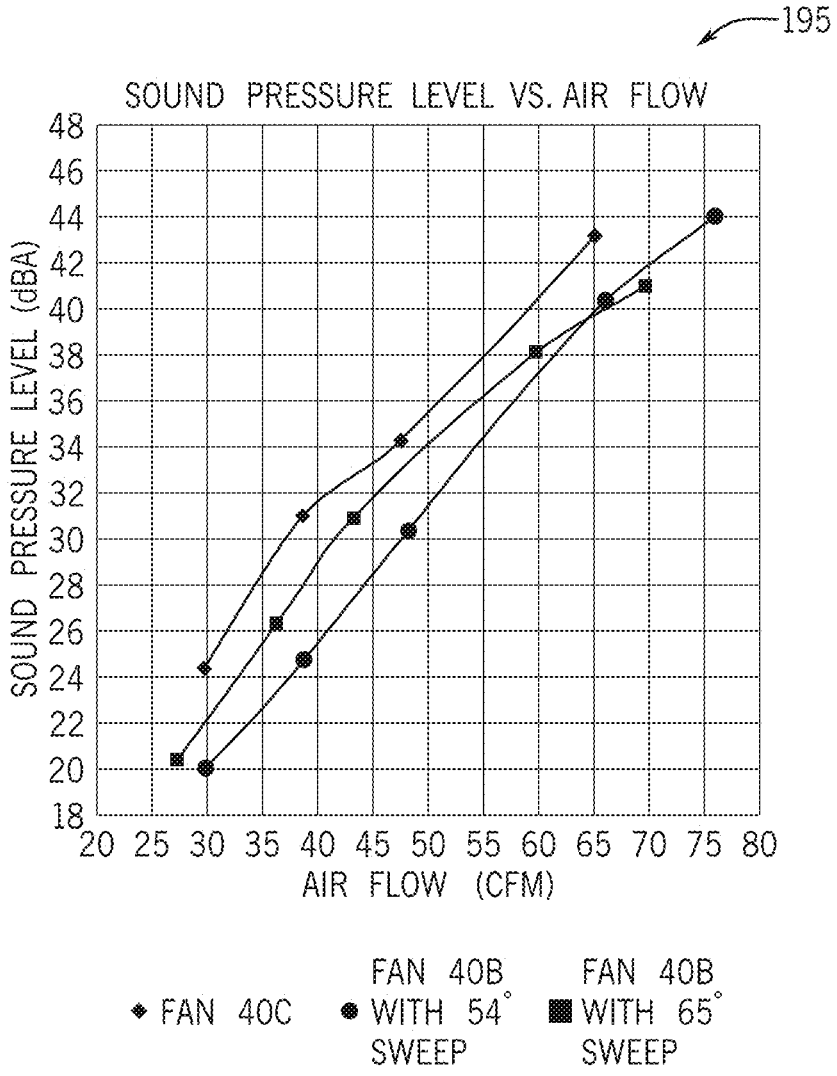
FIG. 21 is an example of a graph illustrating a correlation between a produced air flow rate and a magnitude of generated acoustic energy that may be generated for various fans with different blade sweep angles, in accordance with an embodiment of the present disclosure.

FIG. 13 is an embodiment of a graph 192 illustrating a magnitude of acoustic energy that may be generated by the fan 40B at various frequencies for a particular operational speed (e.g., in revolutions per minute) of the fan 40B that is equal to the operational speed of fan 40C of FIG. 12. As shown in the illustrated embodiment, the inclusion of the rotating inlet flange 160 may significantly reduce a magnitude of acoustic energy spikes 193 that may be generated by the fan 40B at certain blade pass frequency multiples of the shroudless fan 40C, as compared to the spikes 191 of acoustic energy generated by the shroudless fan 40C at these frequencies.

FIGS. 14-21 are various embodiments of charts 194 and/or graphs 195 illustrating relationships between acoustic energy that may generated by various fans at certain blade pass frequency harmonics or output air flow rates of the fans. In particular, the charts 194 and/or the graphs 195 may compare these parameters with respect to the fan 40A of FIG. 2, the fan 40B of FIG. 4, and the shroudless fan 40C of FIG. 10. It should be noted that FIGS. 17-21 additionally illustrate relationships between the aforementioned parameters and fans (e.g., the fans 40A, 40B, and/or 40C) having various blade sweeps or fan blade angles, which will be discussed in detail below.

Figure 22:
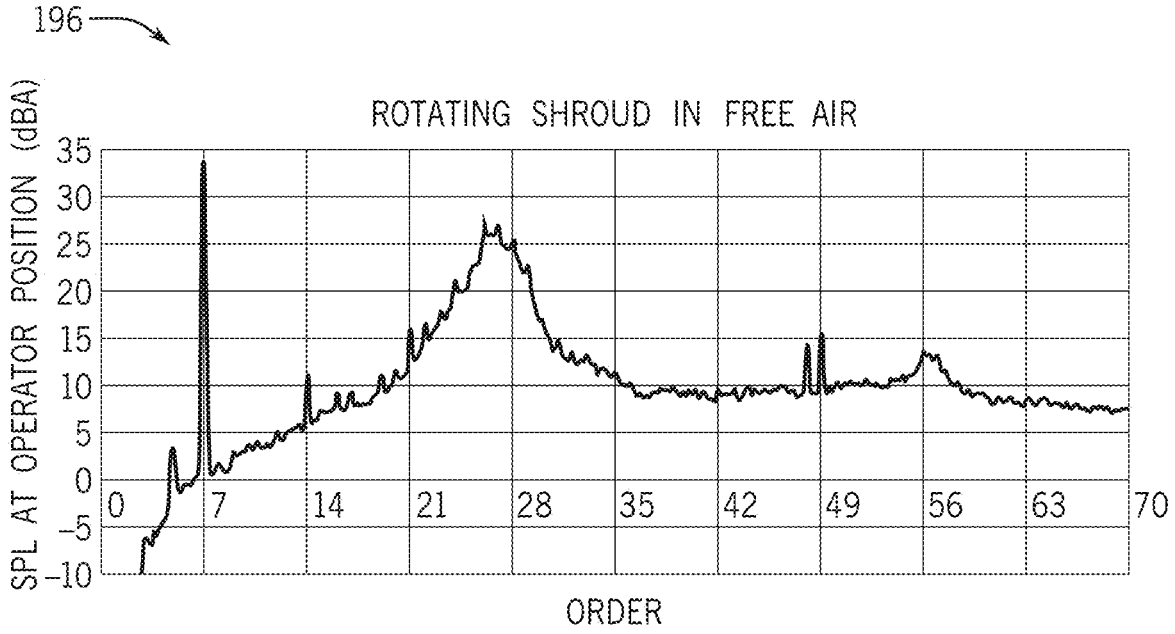
FIG. 22 is an example of a graph illustrating a magnitude of acoustic energy that may be generated by the fan of FIG. 4 in free air, in accordance with an embodiment of the present disclosure.

FIG. 22 is an embodiment of a graph 196 illustrating a magnitude of acoustic energy that may generated by the fan 40B when the fan 40B is not coupled to an enclosure or housing (e.g., not coupled to the enclosure 12). Specifically, the graph 196 illustrates a magnitude of acoustic energy that may be generated at various frequencies for a particular operational speed of the fan 40B while the fan 40B is situated in an ambient environment (e.g., not coupled to another structure or enclosure).

Figure 23:
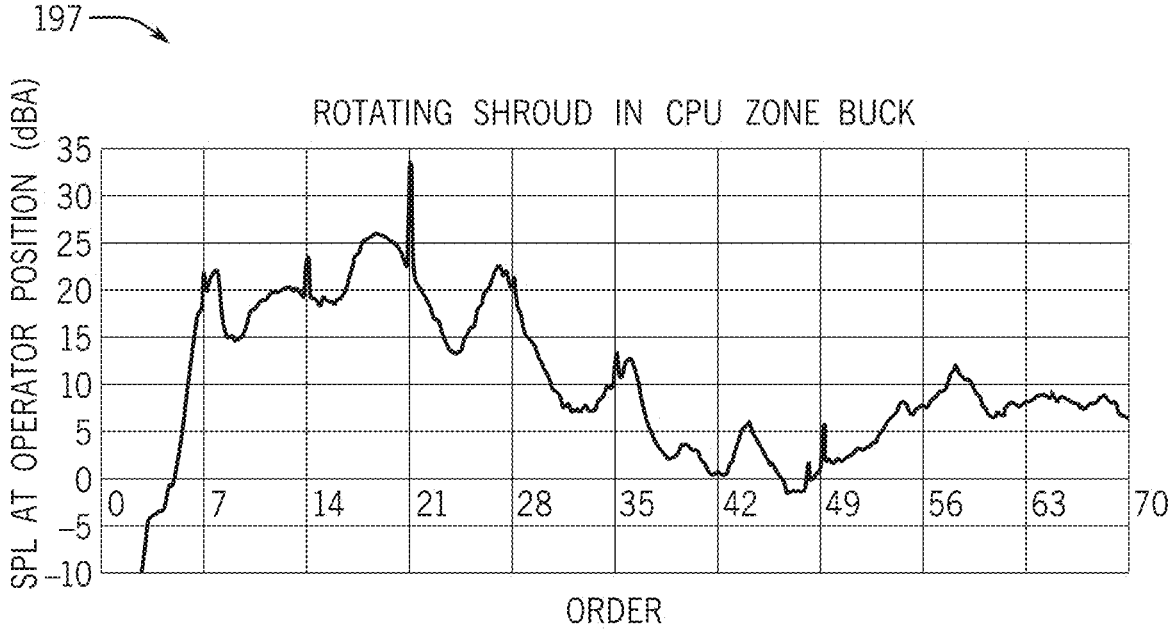
FIG. 23 is an example of a graph illustrating a magnitude of acoustic energy that may be generated by the fan of FIG. 4 when placed within an enclosure, in accordance with an embodiment of the present disclosure.

FIG. 23 is an embodiment of a graph 197 illustrating acoustic energy that may be generated by the fan 40B when the fan 40B is coupled to an enclosure (e.g., the enclosure 12). In particular, the graph 196 illustrates a magnitude of acoustic energy that may be generated at various frequencies for a particular operational speed of the fan 40B that may be the same as the operational speed of the fan 40B in FIG. 22.

Figure 24:
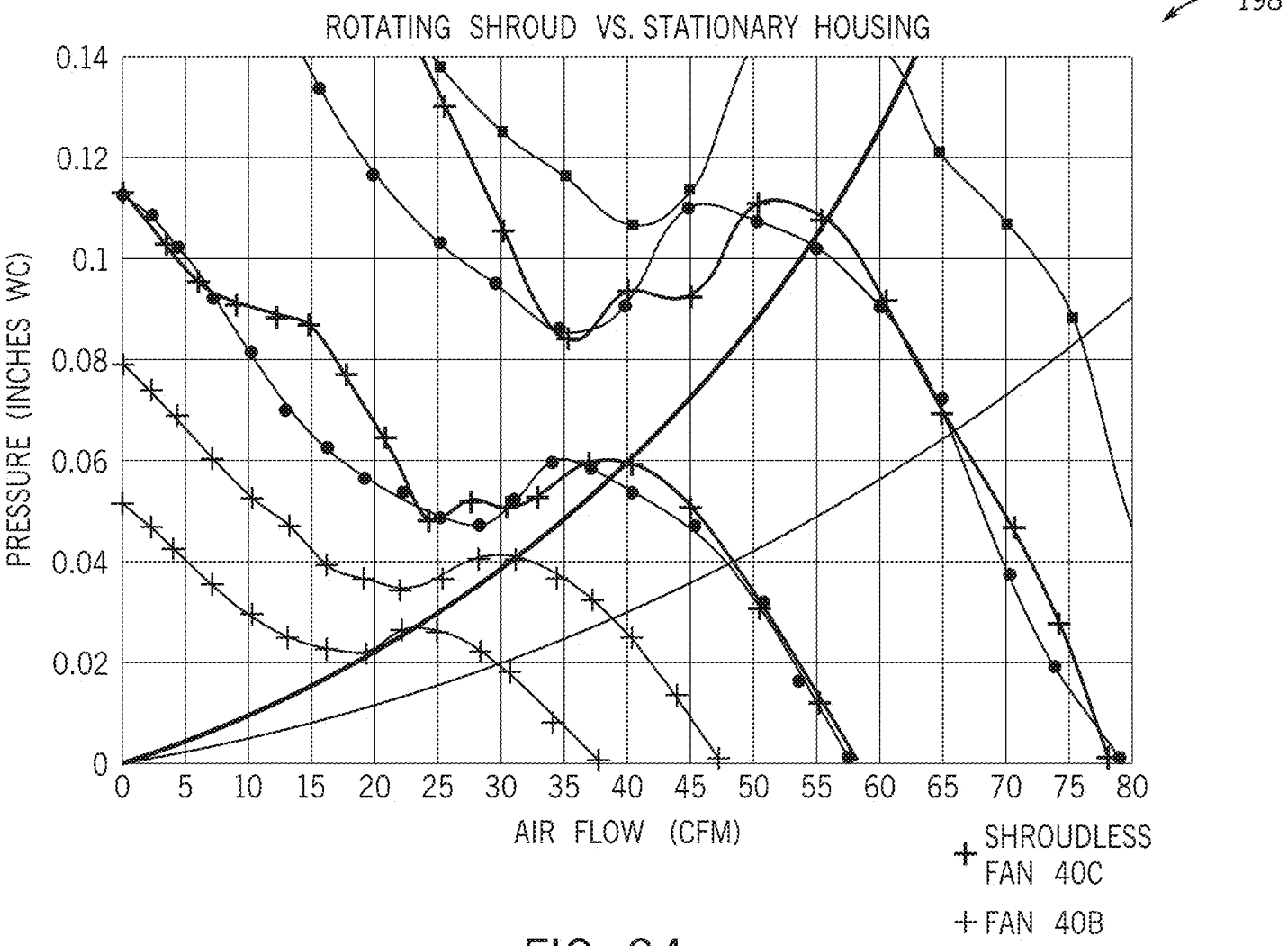
FIG. 24 is an example of a graph illustrating a correlation between a produced air flow rate and a magnitude of generated static pressure for various fans, in accordance with an embodiment of the present disclosure.

FIG. 24 is an embodiment of a graph 198 illustrating a correlation between air flow rates (e.g., in cubic feet per minute) that may be generated by various fans and resulting pressure rises that may be formed across a housing (e.g., between an inlet and an outlet) of these fans. In particular, the graph 198 illustrates relationships between the aforementioned parameters with respect to the fan 40B and the shroudless fan 40C.

Figure 25:
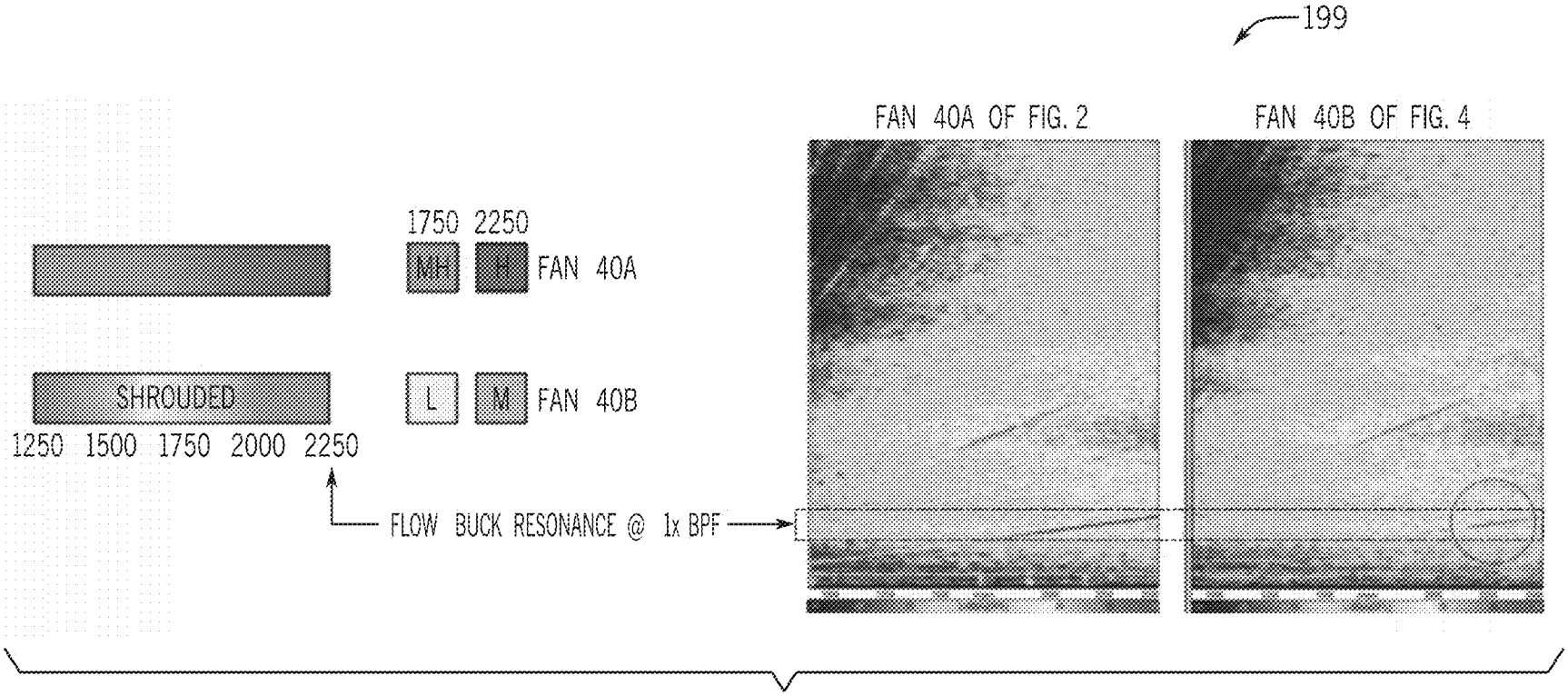
FIG. 25 is an example of a chart illustrating a spectrogram of acoustic energy vs. fan speed and sound frequency generated by the fans of FIGS. 2 and 4, in accordance with an embodiment of the present disclosure.

FIG. 25 is an embodiment of a chart 199 illustrating a magnitude of acoustic energy that may be generated by the fan 40A of FIG. 2 and the fan 40B of FIG. 4 at various blade pass frequencies. As shown in the illustrated embodiment, the fan 40A may generate a moderate to high amount of acoustic energy at certain operation speeds of the fan 40A (e.g. at speeds between 1250 RPM and 2250 RPM). In some embodiments, a predominant portion of this acoustic energy may be generated at the harmonic frequencies of the fan 40A, due to the recirculation of backflow air through the fan 40A. In contrast, the fan 40B may generate acoustic energy of a lesser magnitude (e.g., low to moderate magnitude) throughout the aforementioned operations speeds (e.g., speeds between 1250 RPM and 2250 RPM), because the rotating inlet flange 160 may mitigate an amount of acoustic energy that may be generated at the harmonic frequencies of the fan 40B (e.g., due to the recirculation of backflow air through the fan 40B). Practically speaking, in many implementations, the tonal noise generated by the fan 40A in the medium high to high fan speed ranges may simply be too loud, while conversely, the noise generated by the fan 40B in the same fan speed ranges may be acceptable.

Figure 26:
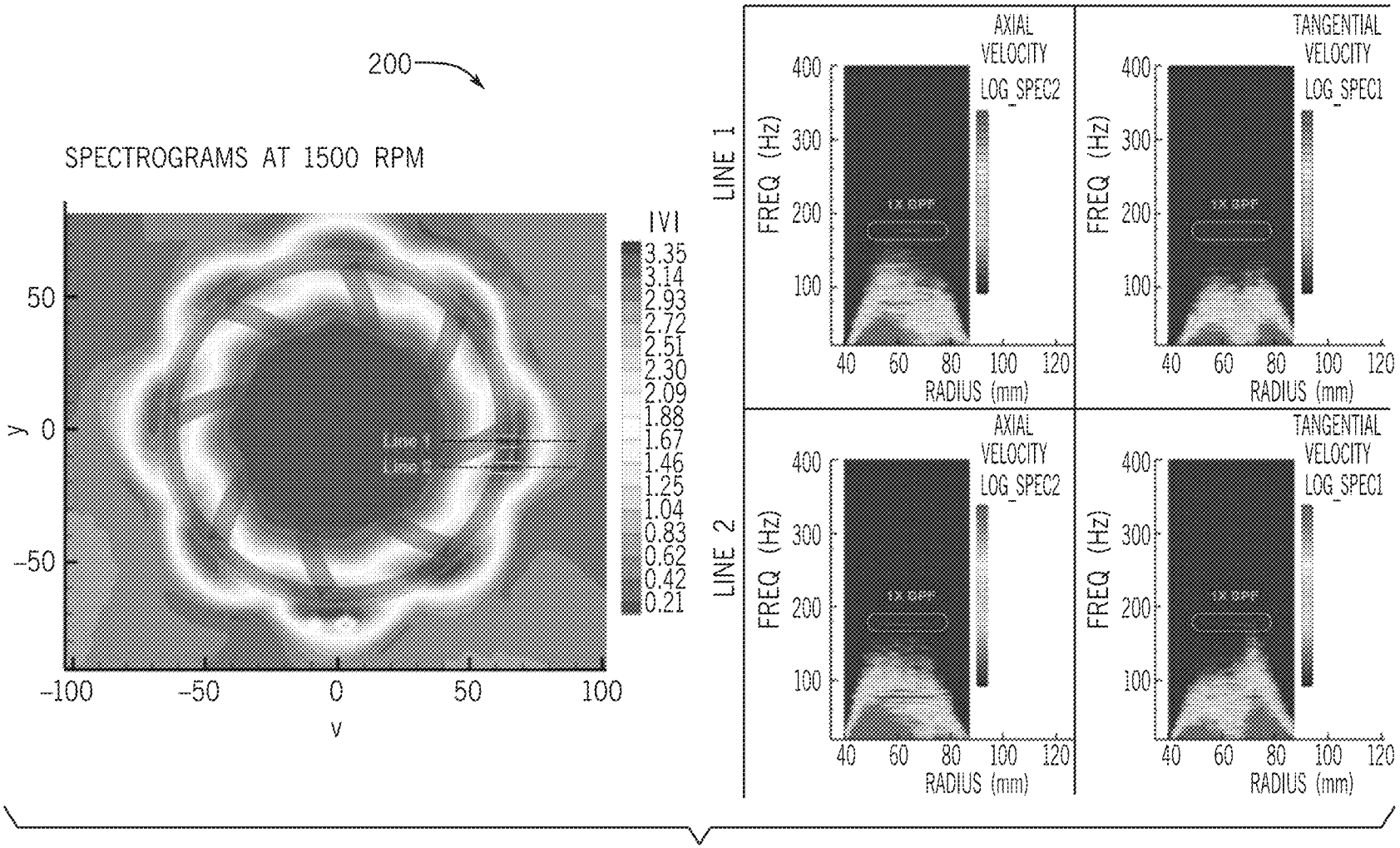
FIG. 26 is an example of a graph illustrating results of a spectrograph analysis of air flow velocity of the fan of FIG. 4, in accordance with an embodiment of the present disclosure.

FIG. 26 is an embodiment of a chart 200 illustrating spectrogram analysis results of the outlet air flow for the fan 40B at a particular operational speed of the fan 40B.

Returning to FIG. 5, although the profile 172 of the rotating inlet flange 160 is shown as having a curved contour in the illustrated embodiment, it should be noted that the rotating inlet flange 160 may alternatively include a linear profile, a stepped or jagged profile, or any other suitable profile or edge. In some embodiments, the rotating inlet flange 160 may protrude vertically past and at least partially across the outer wall 50. For example, a diameter of the rotating inlet flange 160 may be substantially equal to a diameter of the outer wall 50, such that the vertical gap 170 extends axially between the outer wall 50 and the rotating inlet flange 160. That is, a diametric dimension at a distal end 202 of the rotating inlet flange 160 may be substantially equal to a diametric dimension of the outer wall 50 at the first end portion 124. In some embodiments, the rotating inlet flange 160 may extend radially past the outer wall 50. In other embodiments, the rotating inlet flange 160 may terminate at an elevation that is below a height of the first end portion 124 of the outer wall 50, such that the rotating inlet flange 160 does not protrude past the outer wall 50. However, even in such embodiments, the profile 172 of the rotating inlet flange 160 may guide backflow air discharging from the radial gap 120 over the outer wall 50 and in a direction extending away from the centerline 66.

Figure 27:
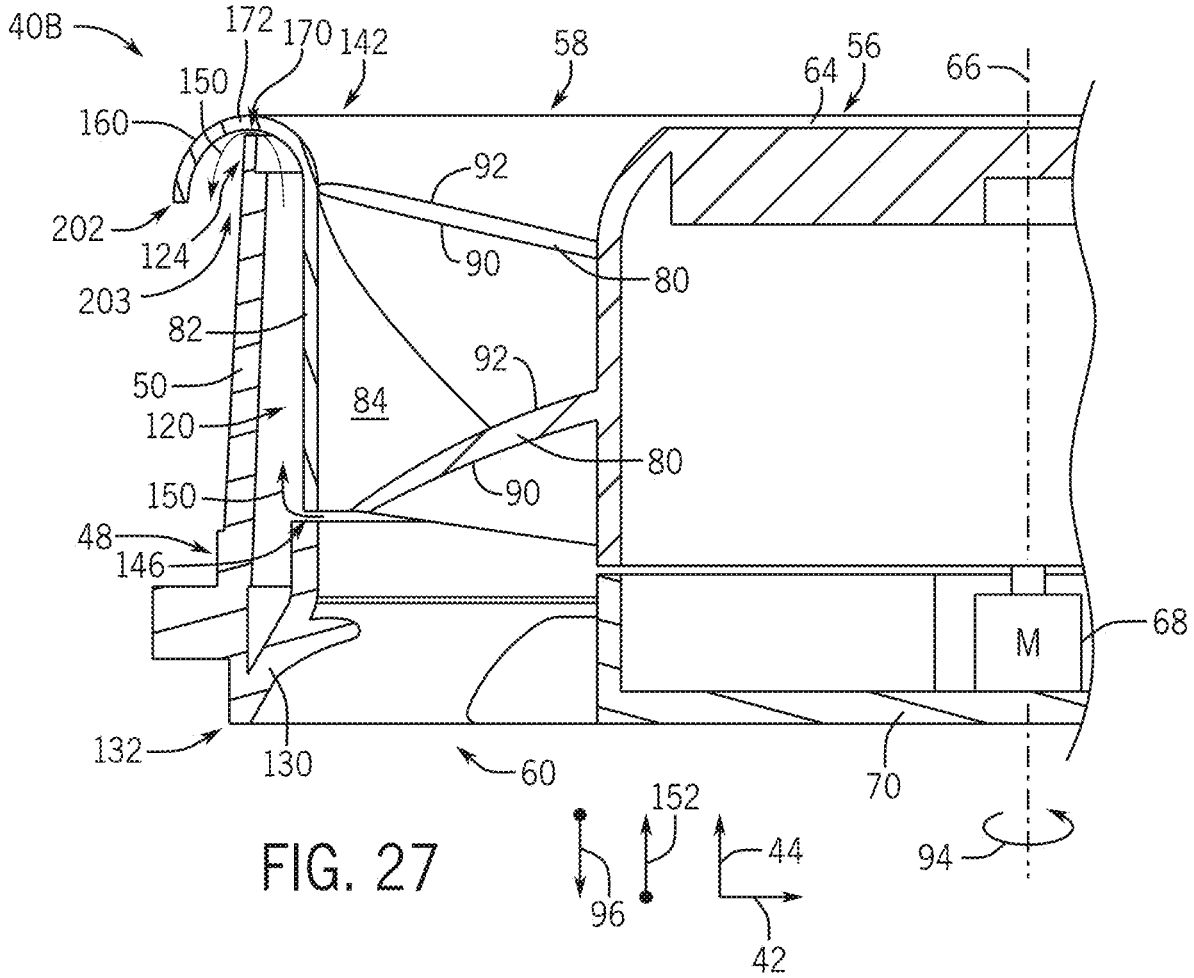
FIG. 27 is partial cross-sectional view of an example of the fan of FIG. 4 having an extended rotating inlet flange, in accordance with an embodiment of the present disclosure.

In certain embodiments, the rotating inlet flange 160 may be configured to discharge the backflow air in a direction substantially similar to an intended direction of air flow through the fan 40B (e.g., along the first direction 96). By way of example, FIG. 27 is a partial cross-sectional view of an embodiment of the fan 40B in which the rotating inlet flange 160 is configured to discharge backflow air generally in the first direction 96. As shown in the illustrated embodiment, the rotating inlet flange 160 extends about the first end portion 124 of the outer wall 50 such that the distal end 202 of the rotating inlet flange 160 may be oriented generally along the vertical axis 44. As such, the rotating inlet flange 160 may form an additional gap 203 (e.g., an additional radial gap, a portion of the vertical gap 170) that extends between an exterior surface of the outer wall 50 and the rotating inlet flange 160. That is, the distal end 202 may be positioned axially between (e.g., with respect to the centerline 66) the first end portion 124 of the outer wall 50 and the second end portion 132 of the outer wall 50 to form the additional gap 203. Accordingly, the rotating inlet flange 160 may receive backflow air (e.g., as shown by the arrow 150) in the second direction 152, guide the backflow air along the profile 172 to redirect a flow direction of the backflow air generally along the first direction 96, and discharge the backflow air toward the outlet 60 of the fan 40B. It should be appreciated that the profile 172 of the rotating inlet flange 160 may be adjusted to discharge the backflow air any other direction extending away from the centerline 66.

Figure 28:
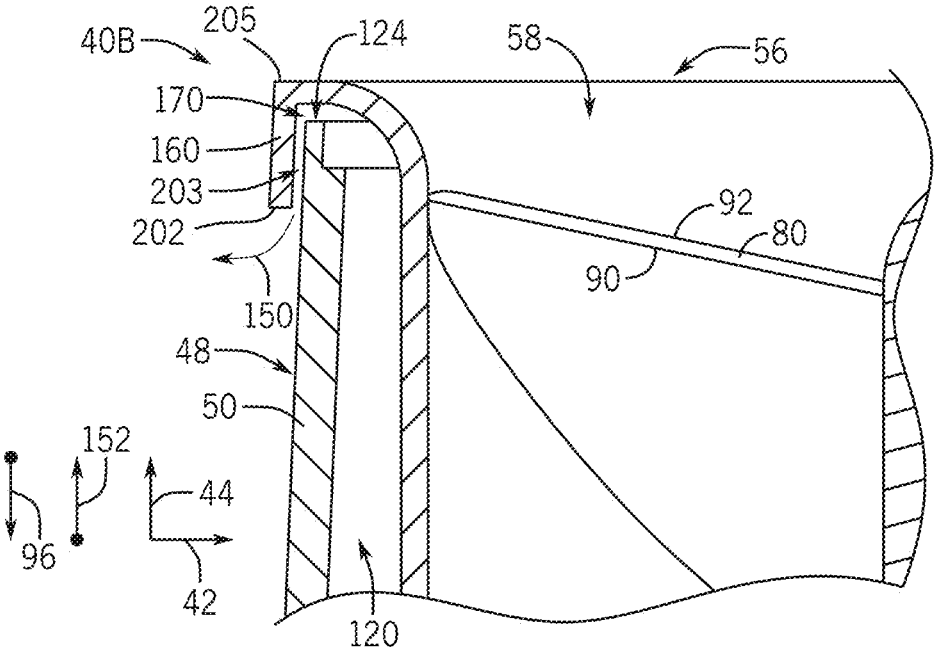
FIG. 28 is close-up cross-sectional view of an example of the fan of FIG. 27 having an extended rotating inlet flange, in accordance with an embodiment of the present disclosure.

FIG. 28 is a close-up cross-sectional view of an embodiment of the fan 40B illustrating another embodiment of the rotating inlet flange 160 that directs backflow air downwardly in the first direction 96. As shown in the illustrated embodiment, the rotating inlet flange 160 may extend substantially close to an exterior surface of the outer wall 50 (e.g., within 0.5 mm to 2 mm of the exterior surface of the outer wall 50). Accordingly, the rotating inlet flange 160 may not significantly increase a total diametric dimension of the fan 40B, even though the rotating inlet flange 160 extends about the exterior of the outer wall 50 (e.g., protrudes radially past the outer wall 50). As such, multiple fans 40B may be placed in close proximity to one another without interference between the rotating inlet flanges 160 of the fans 40B. In some embodiments, a width (e.g., a radial dimension) of the additional gap 203 may be substantially constant along a length of the additional gap 203. That is, a portion of the rotating inlet flange 160 extending from an intermediate portion 205 of the rotating inlet flange 160 to the distal end 202 of the rotating inlet flange 160 may extend substantially parallel to an exterior surface of the outer wall 50 (e.g., at a distance within 0.5 mm to 2 mm of the exterior surface of the outer wall 50).

In certain embodiments, the fan 40B may be configured to discharge the backflow air non-uniformly (e.g., non-axisymmetric) about a circumference of the outer wall 50. In other words, the fan 40B may be configured to discharge the backflow air along a first portion of the outer wall 50 at a flow rate that is less than or greater than a flow rate of backflow air discharged along a second portion of the outer wall 50. As discussed in detail below, this configuration may enable multiple fans 40B to be positioned in close proximity to one another while mitigating a transfer of backflow air between adjacent fans 40B. Accordingly, this flow biasing technique may reduce audible noise that may be generated due to the recirculation of backflow air between neighboring fans 40B.

Figure 29:
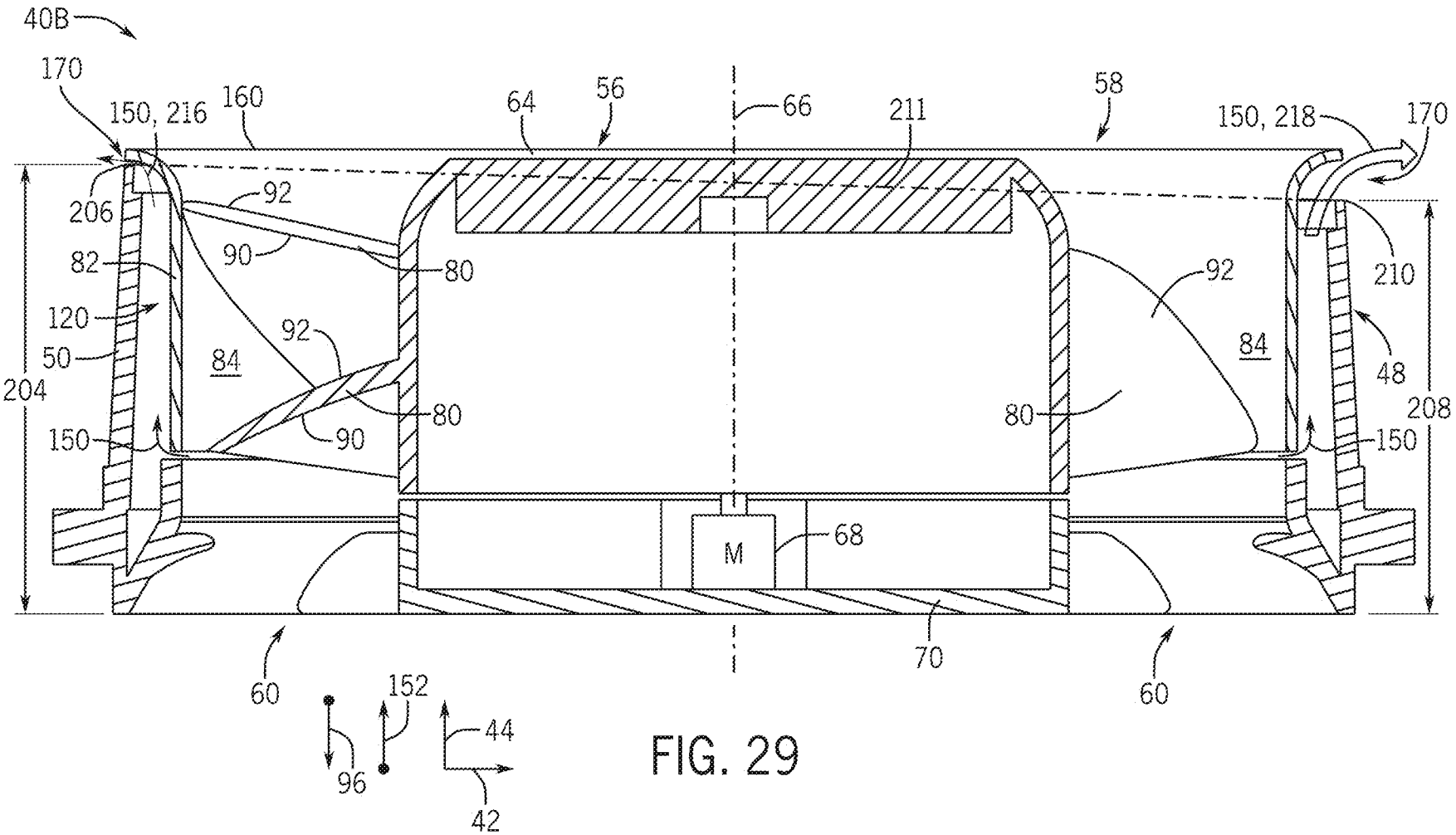
FIG. 29 is a cross-sectional view of an example of the fan of FIG. 4 having a variable axial gap, in accordance with an embodiment of the present disclosure.

To facilitate discussion, FIG. 29 is a cross-sectional view of an embodiment of the fan 40B. In the illustrated embodiment, the outer wall 50 has a first height 204 (e.g., a maximum height) at a first point 206 along the outer wall 50, and has a second height 208 (e.g., a minimum height) at a second point 210 along the outer wall 50 (e.g., a point diametrically opposite the first point 206). A height of the outer wall 50 may decrease uniformly or non-uniformly on either side of the fan 40B from the first point 206 to the second point 210. As an example, line 211 illustrates a height variation of the outer wall 50 between the first point 206 and the second point 210.

It is important to note that such height variations along the outer wall 50 (e.g., variations in a circumferential height profile of the outer wall 50) may vary a width of the vertical gap 170 at various locations about the outer wall 50. That is, the width of the vertical gap 170 may increase or decrease about a circumference of the outer wall 50 proportionally to a decrease or increase, respectively, in a local height of the outer wall 50. As such, in the present example, a first width of the vertical gap 170 may be relatively small at the first point 206 (e.g., a constricted section) of the outer wall 50, while a second width of the vertical gap 170 is relatively large at the second point 210 (e.g., an expanded section) of the outer wall 50.

Adjusting a local width of the vertical gap 170 may facilitate regulating flow parameters (e.g., flow rate, dynamic pressure) of the backflow air discharging from the radial gap 120. For example, restricting a width of the vertical gap 170 along a particular section of the outer wall 50 may decrease the flow rate of backflow air discharging near this section of the outer wall 50. Conversely, enlarging the width of the vertical gap 170 along a section of the outer wall 50 may increase the flow rate of the backflow air discharging near this section of the outer wall 50. Accordingly, height variations along the outer wall 50 may be used to bias a discharge of backflow air to certain portion(s) of the fan 40. Specifically, in the present example, a flow rate of the backflow air near the first point 206 may be relatively small, as indicated by arrow 216, while a flow rate of the backflow air is relatively large near the second point 210, as indicated by arrow 218.

Figure 30:
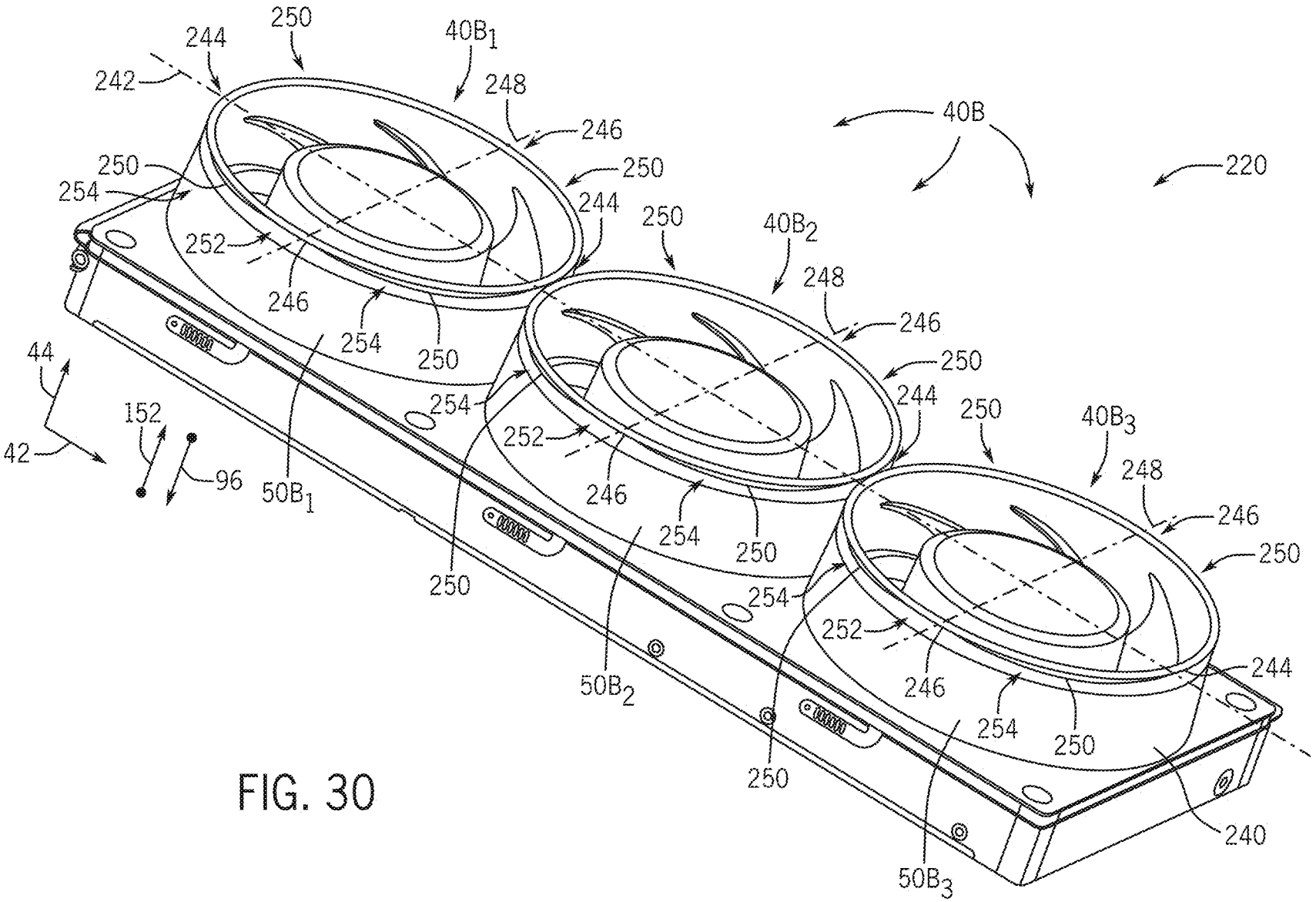
FIG. 30 is a perspective view of an example of a flow generation unit having fans of FIG. 29, in accordance with an embodiment of the present disclosure.

As another clarifying example, FIG. 30 is a perspective view of an embodiment of a flow generation unit 220 that includes a plurality of fans 40B. Specifically, the illustrated embodiment of the flow generation unit 220 includes a first fan 40$B_1$, a second fan 40$B_2$, and a third fan 40$B_3$, which respectively include a first outer wall 50$B_1$, a second outer wall 50$B_2$, and a third outer wall 50$B_3$ that are integrated within a common housing 240. To facilitate the subsequent discussion, it should be noted that the first, the second, and the third outer walls 50$B_1$, 50$B_2$, 50$B_3$ are bisected by a centerline 242 extending through diametric endpoints of the outer walls 50$B_1$, 50$B_2$, 50$B_3$.

In the exemplary embodiment of the flow generation unit 220 discussed herein, the first outer wall 50$B_1$, the second outer wall 50$B_2$, and the third outer wall 50$B_3$ each include respective maximum heights at crest points 244, which are positioned along the centerline 242, and crest points 246, which are position along respective axes 248 extending generally orthogonal to the centerline 242. Respective minimum heights of the first outer wall 50$B_1$, the second outer wall 50$B_2$, and the third outer wall 50$B_3$ are located at respective trough points 250, which may be positioned between (e.g., at a midpoint of) respective crest points 244, 246.

The respective heights (e.g., respective height profiles) of the first, the second, and the third outer walls 50$B_1$, 50$B_2$, 50$B_3$ may vary uniformly or non-uniformly between the crest points 244, 246 and the respective trough points 250. In this manner, the fans 40$B_1$, 40$B_2$, 40$B_3$ may each include constricted sections 252 along which respective vertical gaps 170 of the fans 40$B_1$, 40$B_2$, 40$B_3$ are relatively small at the crest points 244, 246 and expanded sections 254 along which the respective vertical gaps 170 are relatively large at the trough points 250.

As shown in the illustrated embodiment, the constricted sections 252 may be disposed between each of the fans 40, while the expanded sections 254 are located near portions the outer walls 50$B_1$, 50$B_2$, 50$B_3$ that are oriented away from one another. In this manner, each of the fans 40$B_1$, 40$B_2$, 40$B_3$ may discharge a majority of their respective backflow air in a radial direction that is oriented away from neighboring fans 40$B_1$, 40$B_2$, 40$B_3$ of the flow generation unit 220. This flow biasing configuration may therefore decrease a quantity of backflow air that may be discharged from one fan (e.g., the first fan 40$B_1$) and ingested by and recirculated through an adjacent fan (e.g., the second fan 40$B_2$).

Figure 31:
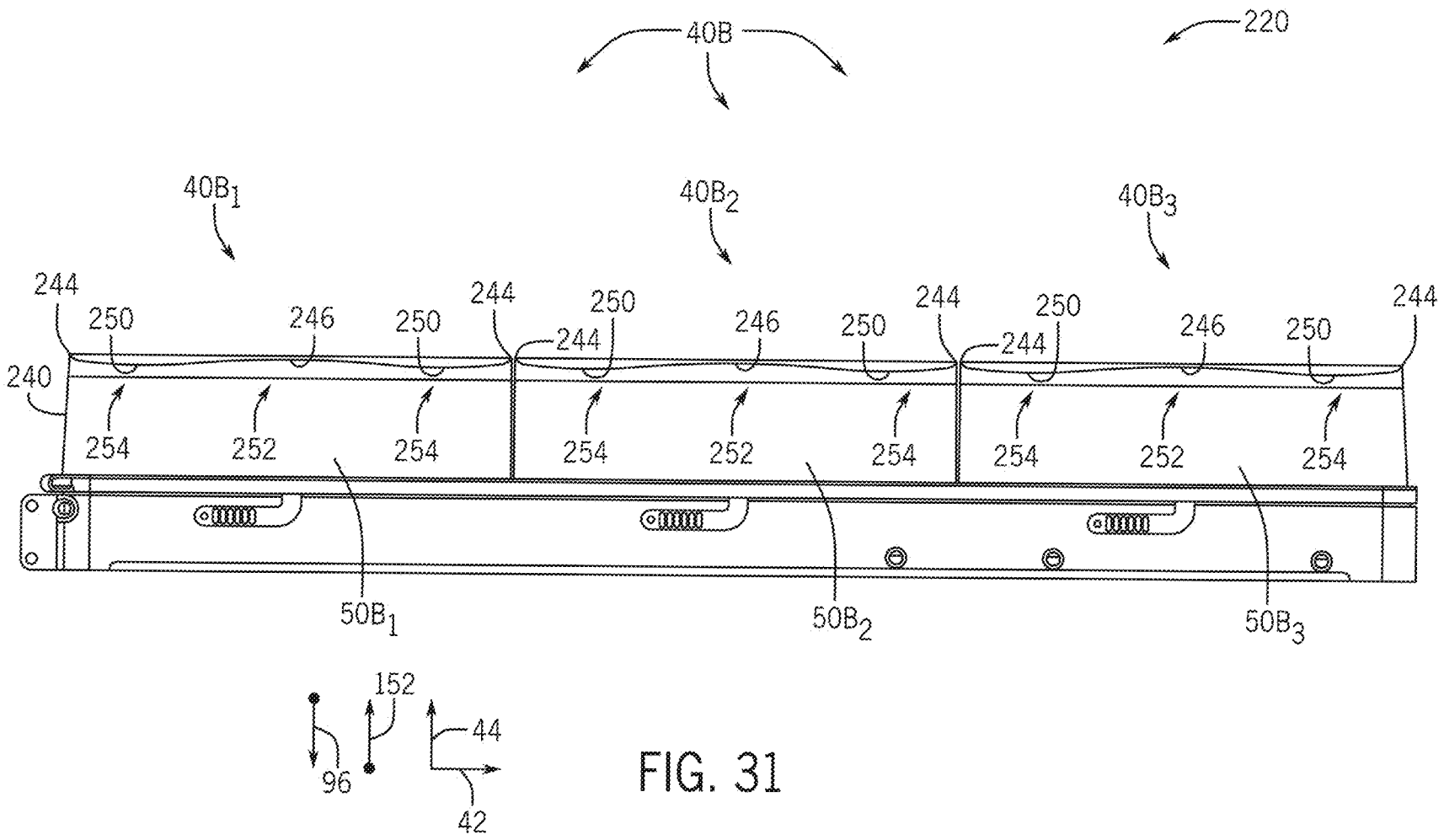
FIG. 31 is planar view of an example of the flow generation unit of FIG. 30, in accordance with an embodiment of the present disclosure.

For clarity, FIG. 31 is a planar side view of an embodiment of the flow generation unit 220, illustrating the constricted sections 252 and the expanded sections 254 of the fans 40$B_1$, 40$B_2$, 40$B_3$. It should be appreciated that in other embodiments, the crest points 244, 246 and/or the trough points 250 may be positioned along any other portion(s) of the first, the second, and the third outer walls 50$B_1$, 50$B_2$, 50$B_3$.

Figure 32:
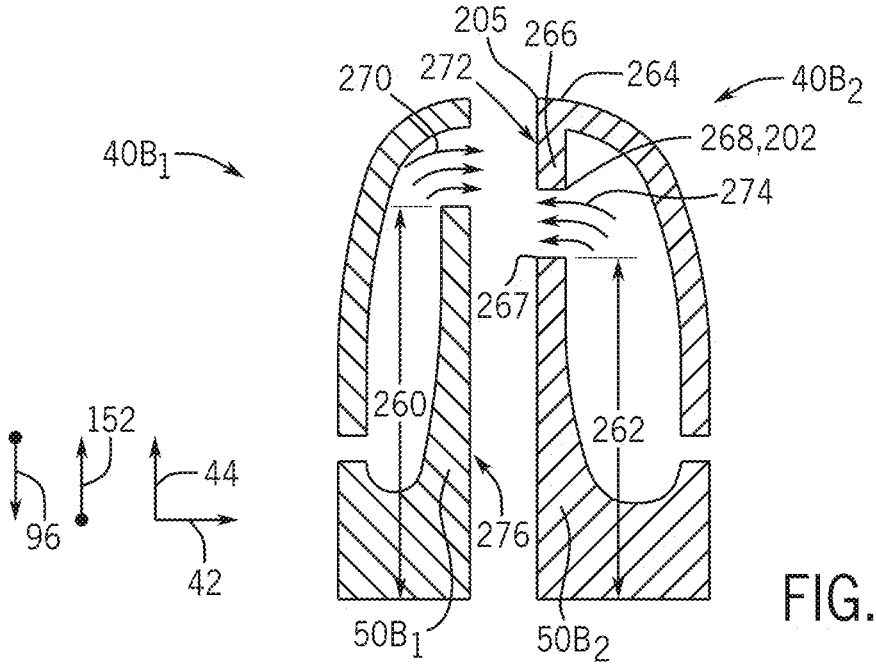
FIG. 32 is a partial cross-sectional view of an example of a pair of adjacent fans at a rotating inlet flange interface, in accordance with an embodiment of the present disclosure.

In some embodiments, backflows of air of adjacent fans 40B may be discharged at different elevations, thereby reducing a likelihood of backflow air interaction between the fans 40B. For example, FIG. 32 is a partial cross-sectional view of an embodiment of adjacent outer walls of a pair of neighboring fans. For sake of discussion, the pair of fans are described as the first and second fans 40$B_1$, 40$B_2$, and will reference their respective components. As shown in the illustrated embodiment, a height 260 (e.g., an axial height, a dimension along the vertical axis 44) of the first outer wall 50$B_1$ exceeds an axial height 262 of the second outer wall 50$B_2$. A rotating inlet flange 264 of the second fan 40$B_2$ includes a protrusion 266 (e.g., an axial protrusion) that extends from the intermediate portion 205 of the rotating inlet flange 264 toward the second outer wall 50$B_2$. A diametric dimension of the intermediate portion 205 may be substantially equal to a diametric dimension of the second outer wall 50$B_2$ (e.g., a diametric dimension at a respective first end portion 267 of the second outer wall 50$B_2$), and the protrusion 266 may extend from the intermediate portion 205 in a direction that may be substantially parallel to the second outer wall 50$B_2$. In some embodiments, the height 260 of the first outer wall 50$B_1$ may be substantially equal to an elevation of a lower end point 268 (e.g., the distal end 202) of the protrusion 266. In other embodiments, the protrusion 266 may extend axially past the first outer wall 50$B_1$, such that the protrusion 266 and the first outer wall 50$B_1$ overlap with one another with respect to the vertical axis 44.

In any case, the differences in height between the first outer wall 50$B_1$ and the second outer wall 50$B_2$ may enable a first backflow of air 270 discharging from the first fan 40$B_1$ to impinge upon a circumferential end face 272 of the protrusion 266, while a second backflow of air 274 discharging from the second fan 40$B_2$ may impinge upon an exterior surface 276 of the first outer wall 50$B_1$. In this manner, the first and second backflows of air 270, 274 may be dispersed into an ambient environment, while a negligible amount of backflow air is directed toward and re-ingested by the first fan 40$B_1$ and/or the second fan 40$B_2$.

Figure 33:
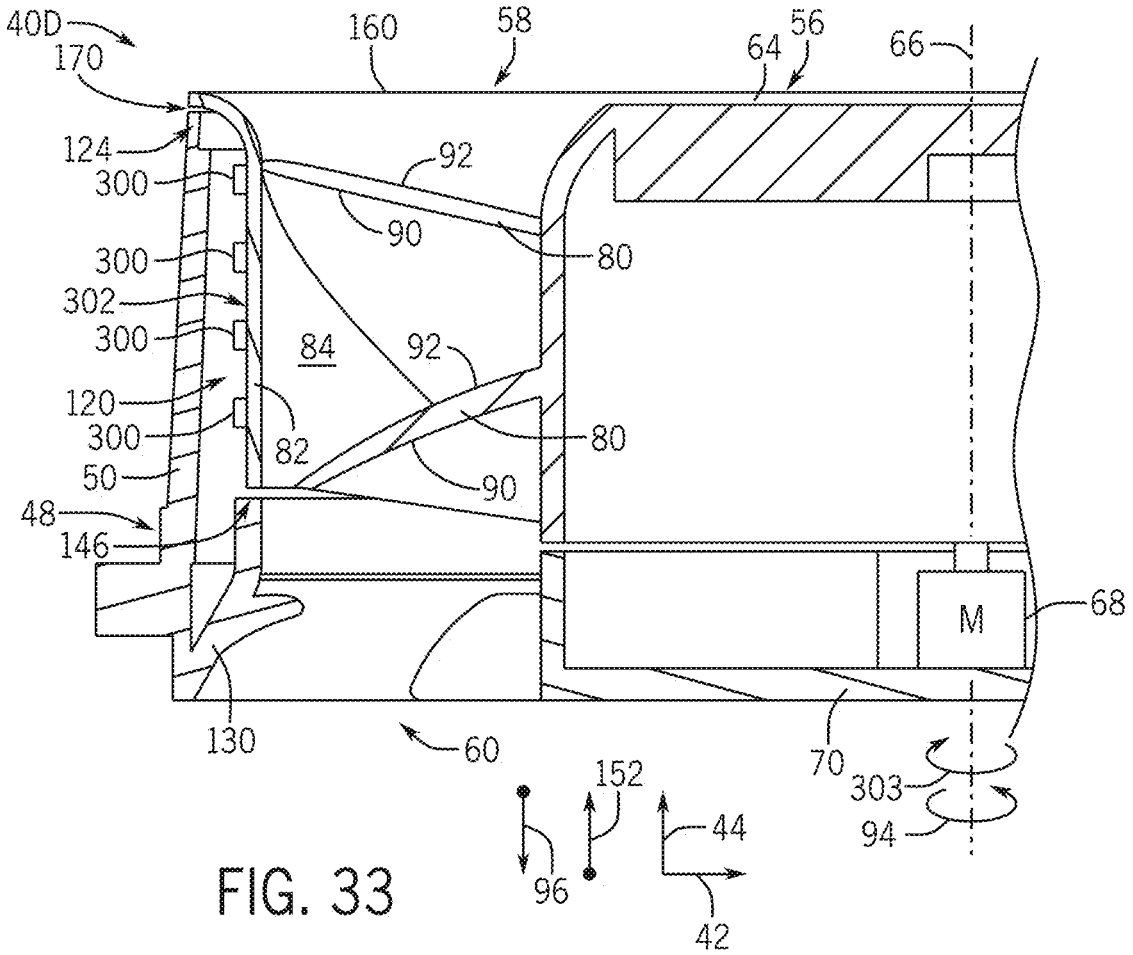
FIG. 33 is a partial cross-sectional view of an example of the fan of FIG. 4 having a helical backflow mitigation feature, in accordance with an embodiment of the present disclosure.

In some embodiments, the fans 40A, 40B, and/or 40C may include a backflow mitigation feature, or multiple backflow mitigation features, which are configured to reduce or substantially eliminate a flow of backflow air through the radial gap 120. For example, FIG. 33 is a partial cross-sectional view of an embodiment of a fan 40D (e.g., any one of the fans 40A, 40B, and/or 40C) having a backflow mitigation feature 300 disposed about an exterior surface 302 of the shroud 82. As shown in the illustrated embodiment, the backflow mitigation feature 300 may include protrusions that extend radially from the shroud 82, toward an interior surface of the outer wall 50. In some embodiments, these protrusions spiral helically downward (e.g., along the first direction 96) in a clockwise direction 303 about the shroud 82. That is, the backflow mitigation feature 300 descends from the inlet 58 toward the outlet 60 while revolving about the shroud 82 in the clockwise direction 303. In some embodiments, the backflow mitigation features 300 may descend about the shroud 82 in the same profile as the fan blades 80 (e.g., a profile at an interface between the fan blades 80 and the shroud 82).

The backflow mitigation feature 300 may engage with air occupying the radial gap 120 when the rotor assembly 56 rotates about the centerline 66 (e.g., in the counter-clockwise direction 94), such that the backflow mitigation feature 300 may attempt to partially block the flow of air in the second direction 152 or force the air in the first direction 96. In some embodiments, the backflow mitigation feature 300 may thereby generate a pressure within the radial gap 120 that is sufficient to fully or partially counteract the pressure differential generated between the vertical gap 170 and the second vertical gap 146 during operation of the fan 40D and, thus, result in substantially reduced or eliminated air backflow in the radial gap 120. Accordingly, the backflow mitigation feature 300 may generate a stagnation of air within the radial gap 120 that substantially blocks additional air from entering the radial gap 120 via the second vertical gap 146, or discharging from the radial gap 120 via the vertical gap 170. In this manner, the backflow mitigation feature 300 may reduce, or substantially eliminate a flow of backflow air through the radial gap 120.

Figure 34:
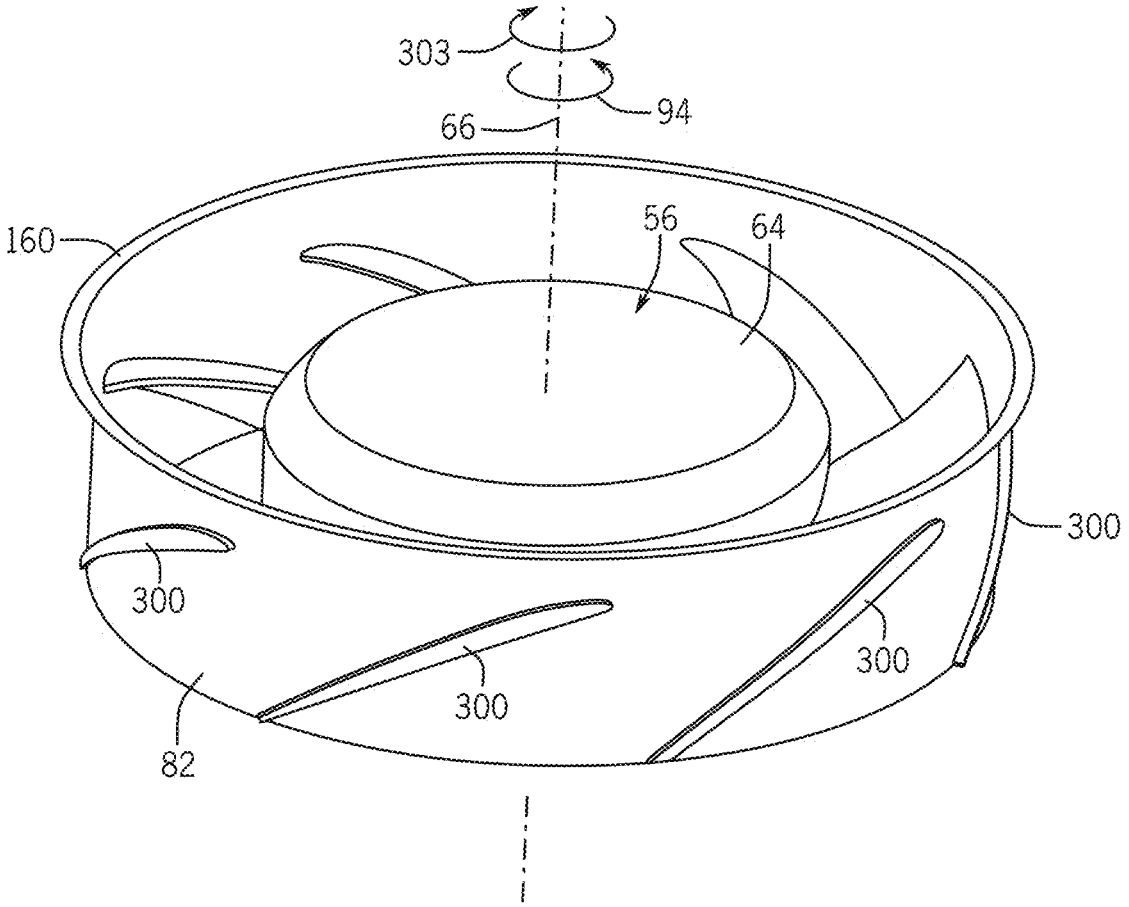
FIG. 34 is a perspective view of an example of the fan of FIG. 4 having discrete backflow mitigation features, in accordance with an embodiment of the present disclosure.

In some embodiments, the backflow mitigation feature 300 may include a single helical protrusion that extends continuously about a circumference of the shroud 82. However, in other embodiments, the backflow mitigation feature 300 may include multiple separated features or protrusions that may be spaced equally (e.g., in an axisymmetric or uniform manner) about the circumference of the shroud 82 (e.g., as shown in the illustrated embodiment of FIG. 34). Although the protrusions of the backflow mitigation feature 300 are shown as having a quadrilateral cross-sectional shape in the illustrated embodiment of FIG. 33, it should be noted that the backflow mitigation feature 300 may include any other suitable cross-sectional shape including, but not limited to, a semi-circular cross-sectional shape, a triangular cross-sectional shape, or a non-uniform cross-sectional shape. Moreover, it should be noted that a cross-sectional shape and/or a protrusion width (e.g., a dimension by which the backflow mitigation feature 300 extends radially from the shroud 82) of the backflow mitigation feature 300 may vary along a height (e.g., a dimension along the vertical axis 44) of the shroud 82.

As an example, in some embodiments, the backflow mitigation feature 300 may include a first group of features that are positioned on the shroud 82 near the inlet 58 and have a first cross-sectional shape and a first protrusion width, while a second group of features are positioned on the shroud 82 near the outlet 60 and have a second cross-sectional shape (e.g., a different cross-sectional shape) and a second protrusion width (e.g., a different protrusion width). It should be appreciated that the geometry and/or the protrusion width of the backflow mitigation feature 300 may be tuned to minimize air backflow through the radial gap 120 at particular operational speeds of the fan 40D.

In certain embodiments, the backflow mitigation feature 300 may include a portion of the fan blades 80. For example, in some embodiments, the rotor assembly 56 may be manufactured (e.g., via an injection molding process) such that one or more of the fan blades 80 protrude radially through the shroud 82, thereby forming the backflow mitigation feature 300. Accordingly, during operation of the fan 40D, a portion of the fan blades 80 protruding radially past the shroud 82, referred to herein as a protruding portion, may engage the air within the radial gap 120 (e.g., via the pressure surface 90 of the fan blades 80) and thereby attempt to force the air in the first direction 96. Similar to the discussion above, in this manner, the protruding portion of the fan blades 80 may generate a static pressure rise in the first direction 96 within the radial gap 120 that may be sufficient to counteract the pressure differential between the vertical gap 170 and the second vertical gap 146 of the fan 40D, thus blocking a backflow of air through the radial gap 120.

In some embodiments, the rotor assembly 56 may be manufactured as a single piece component via an injection molding process. For example, to form the rotor assembly 56, a heated (e.g., liquid) polymeric material may be injected into a mold (e.g., a negative mold) having the shape of the rotor assembly 56. Upon cooling of the polymeric material, the mold may be split (e.g., into two or more individual pieces), thereby enabling removal of the rotor assembly 56 from the mold. However, due to its shape, mold lines may form on certain portions of the rotor assembly 56 that were adjacent to seams of the mold during the injection molding process. Specifically, mold lines may be formed on the inner surface of the shroud 82 and outer surface of the hub 64. Unfortunately, such mold lines may cause turbulent air flow during operation of the fan 40 (e.g., any of the fans 40A, 40B, 40C, 40D), which may generate acoustic energy (e.g., audible noise) during operation of the fans 40A, 40B, 40C, and/or 40D.

Figure 35:
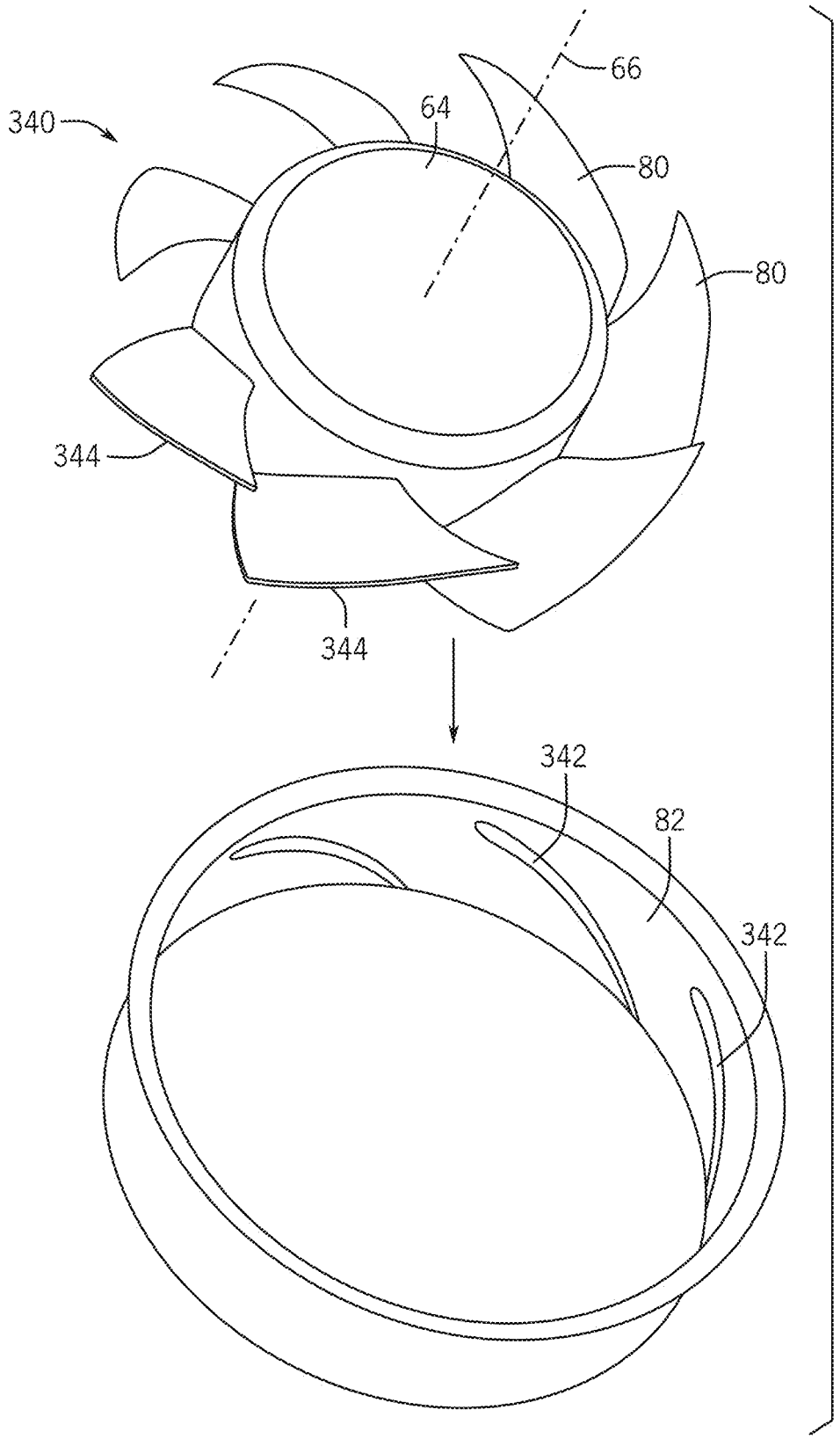
FIG. 35 is a perspective view of an example of an unassembled two-piece rotor assembly that may be used to manufacture the fan of FIG. 4, in accordance with an embodiment of the present disclosure.

In some embodiments, to facilitate manufacture of the rotor assembly 56 and prevent the formation of mold lines on certain portions of the rotor assembly 56 (e.g., the fan blades 80), the hub 64 and the fan blades 80 may be formed as a single-piece component that is separate of the shroud 82 (e.g., in a two-piece design). For example, as shown in the illustrated embodiment of FIG. 35, the hub 64 and the fan blades 80 may be formed as a blade assembly 340, which is separate of the shroud 82. As discussed in detail below, in such embodiments, the shroud 82 may include a plurality of grooves 342 (e.g., helical grooves) that are configured to receive respective blade tips 344 (e.g., end faces) of the fan blades 80 and enable the blade assembly 340 to couple to the shroud 82.

Figure 36:
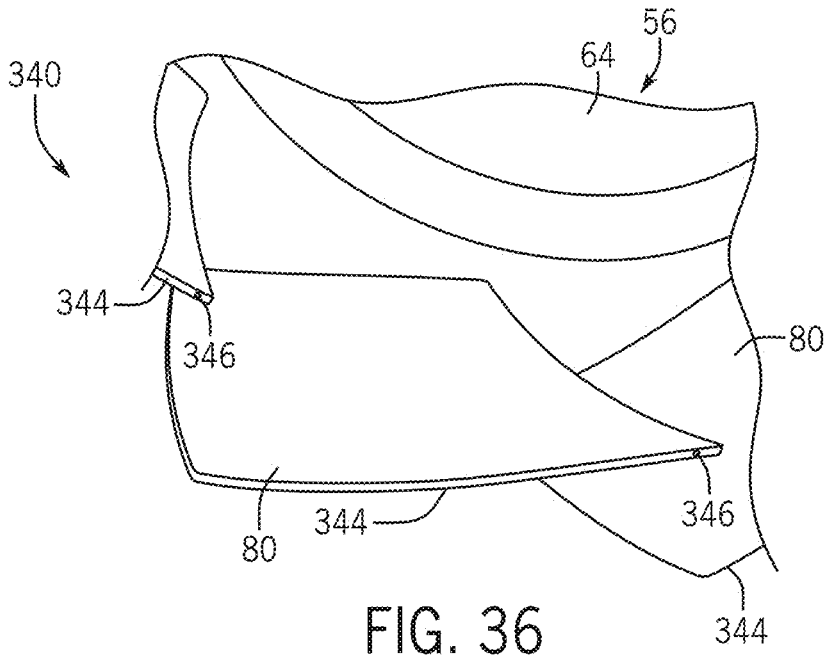
FIG. 36 is a close-up perspective view of an embodiment of fan blades of the rotor assembly of FIG. 35, in accordance with an embodiment of the present disclosure.
Figure 37:
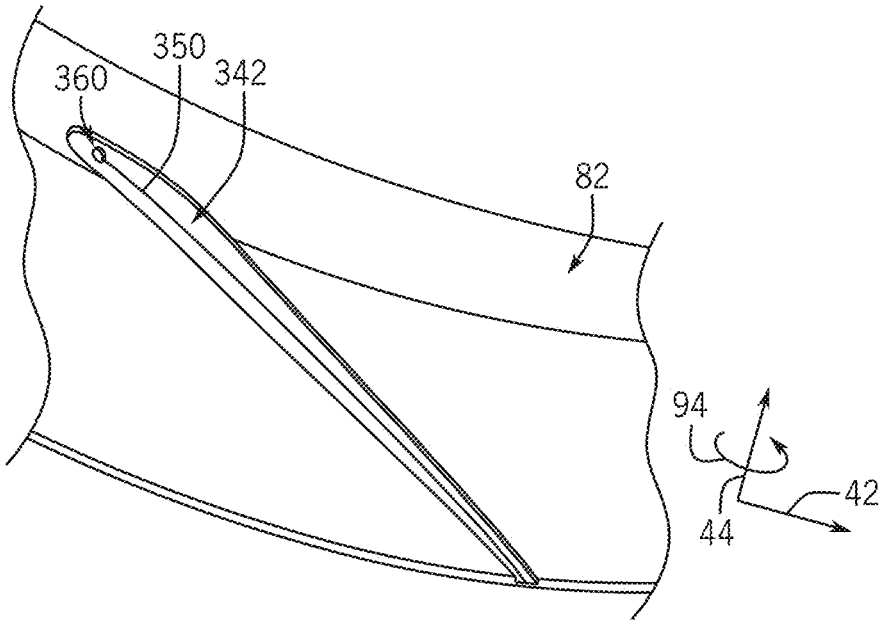
FIG. 37 is a close-up perspective view of an embodiment of the shroud of the rotor assembly of FIG. 35, in accordance with an embodiment of the present disclosure.

To facilitate discussion, FIG. 36 is a close-up perspective view of an embodiment of the fan blades 80. In some embodiments, each of the fan blades 80 may include one or more protrusions 346 (e.g., spherical nubs) that extend radially from the blade tips 344. Each of the protrusions 346 may be configured engage with a recess 350 (e.g., as shown in FIG. 37) disposed within a respective one of the grooves 342. For example, to insert the blade assembly 340 into the shroud 82, each of the fan blades 80 may first be aligned with corresponding grooves 342. Subsequently, the blade assembly 340 may be rotated relative to the shroud 82 (e.g., in the counter-clockwise direction 94) such that the blade tips 344 may navigate along a length of the grooves 342 and draw the blade assembly 340 into the shroud 82.

In some embodiments, radial dimensions extending between the protrusions 346 and a center of the blade assembly 340 may exceed respective radial dimensions extending between the recesses 350 and a center of the shroud 82 (e.g., by approximately 0.5 mm). Accordingly, the shroud 82, the blade assembly 340, or both, may temporarily deform while the blade assembly 340 is inserted into the shroud 82.

For example, in some embodiments, the blade assembly 340 may be constructed of a relatively rigid material, such as glass-filled plastic, while the shroud 82 may be constructed of an elastically deformable material, such as a non-glass filled polymeric material. Accordingly, the shroud 82 may temporarily deform (e.g., flex, bend) while the blade assembly 340 is inserted into the shroud 82.

The blade assembly 340 may be rotated relative to the shroud 82 until the protrusions 346 of the blade tips 344 engage with respective apertures 360 defined within the shroud 82. Accordingly, upon proper alignment of the blade assembly 340 within the shroud, the shroud 82 may snap (e.g., lock) into place (e.g., return to its pre-deformed state, via a snap fit), and thus, couple the blade assembly 340 to the shroud 82.

In some embodiments, an adhesive (e.g., an epoxy resin) may be disposed within the grooves 342 prior to the mating process of the blade assembly 340 and the shroud 82. This adhesive may lubricate the interface between the blade tips 344 and the grooves 342 during this mating process and facilitate translating the blade tips 344 along the grooves 342, thus facilitating insertion of the blade assembly 340 within the shroud 82. Moreover, the adhesive will harden (e.g., cure) after installation of the blade assembly 340, thereby bonding the blade assembly 340 to the shroud 82 and enhancing a structural rigidity of the rotor assembly 54.

Figure 38:
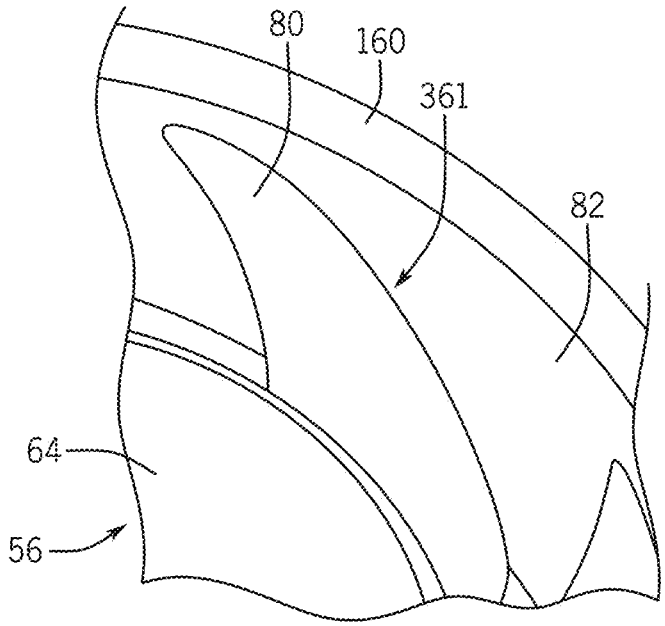
FIG. 38 is a close-up perspective view of an embodiment of the assembled rotor assembly of FIG. 35, in accordance with an embodiment of the present disclosure.
Figure 39:
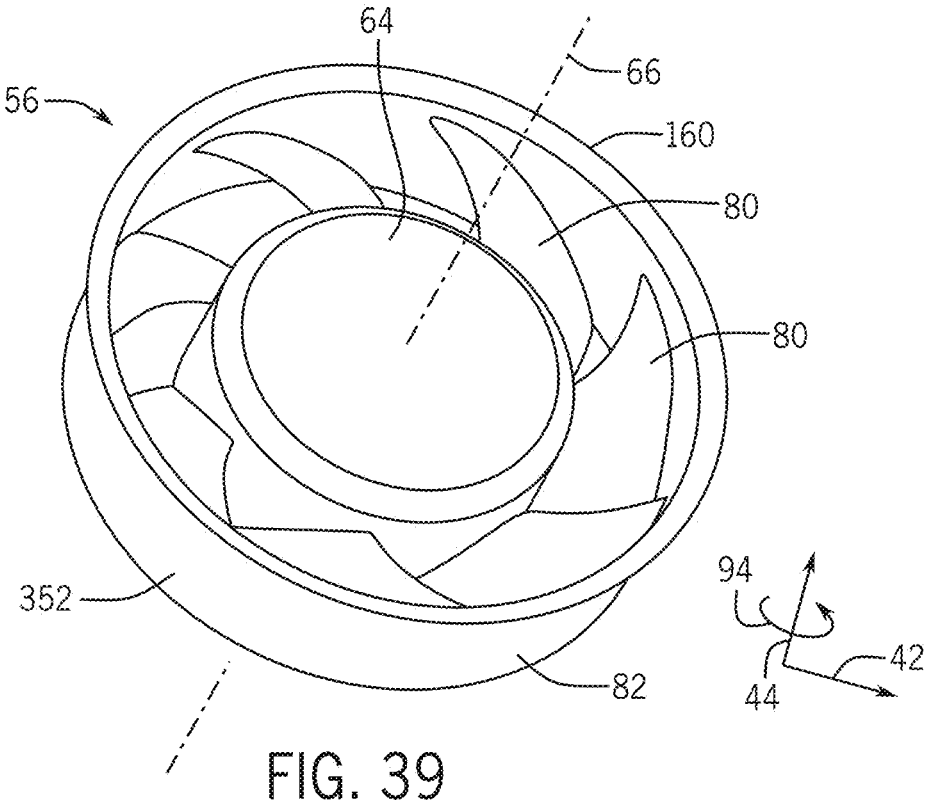
FIG. 39 is a close-up perspective view of an embodiment of the assembled rotor assembly of FIG. 35, in accordance with an embodiment of the present disclosure.

In some embodiments, a diametric dimension between opposing fan blades 80 may be marginally greater than (e.g., by 0.2-0.5 mm) a diametric dimension between opposing grooves 342 of the shroud 82. In this manner, a compressive force may remain between the shroud 82 and the blade tips 344 after installation of the blade assembly 340, which may facilitate forming an air-tight seal (e.g., a fluidic seal) at an interface 361 (e.g., as shown in FIG. 38) between the fan blades 80 and the shroud 82. In some embodiments, the shroud 82 may be heated prior to assembly of the rotor assembly 56, thereby temporarily expanding the shroud 82 (e.g., increasing an inner diameter of the shroud 82). Accordingly, an amount of interference between the blade assembly 340 and the shroud 82 may be reduced to facilitate insertion of the blade assembly 340 into the shroud 82. Upon installation of the blade assembly 340 within the shroud 82, the shroud 82 may cool and contract (e.g., an inner diameter of the shroud 82 may return to a dimension corresponding to an unheated state of the shroud 82). Accordingly, the shroud 82 may apply a compressive force (e.g., radially inward) to the fan blades 80, thereby ensuring that a fluidic seal is created and maintained between the blade tips 344 and the shroud 82. FIG. 39 is a perspective view of and embodiment of the rotor assembly 56 in an assembled configuration, in which the blade assembly 340 is disposed within the shroud 82.

In some embodiments, certain of the grooves 342 may be slots that fully extend through a thickness of the shroud 82. In such embodiments, certain of the fan blades 80 corresponding to these slots (e.g., referred to herein as protruding blades) may be sized to include a radial dimension that exceeds a radial dimension of the shroud 82. Accordingly, upon complete insertion of the blade assembly 340 within the shroud 82, the protruding blades may align with the slots and extend through the slots (e.g., radially past an exterior surface 352 of the shroud 82). The remaining fan blades 80 corresponding to the grooves 342 may concentrically align the blade assembly 340 within the shroud 82 to ensure that the blade assembly 340 is centered within the shroud 82. In this manner, the protruding blades may act as the backflow mitigation feature 300 discussed above, and thereby prevent or substantially reduce a flow of backflow air through the radial gap 120.

Figure 40:
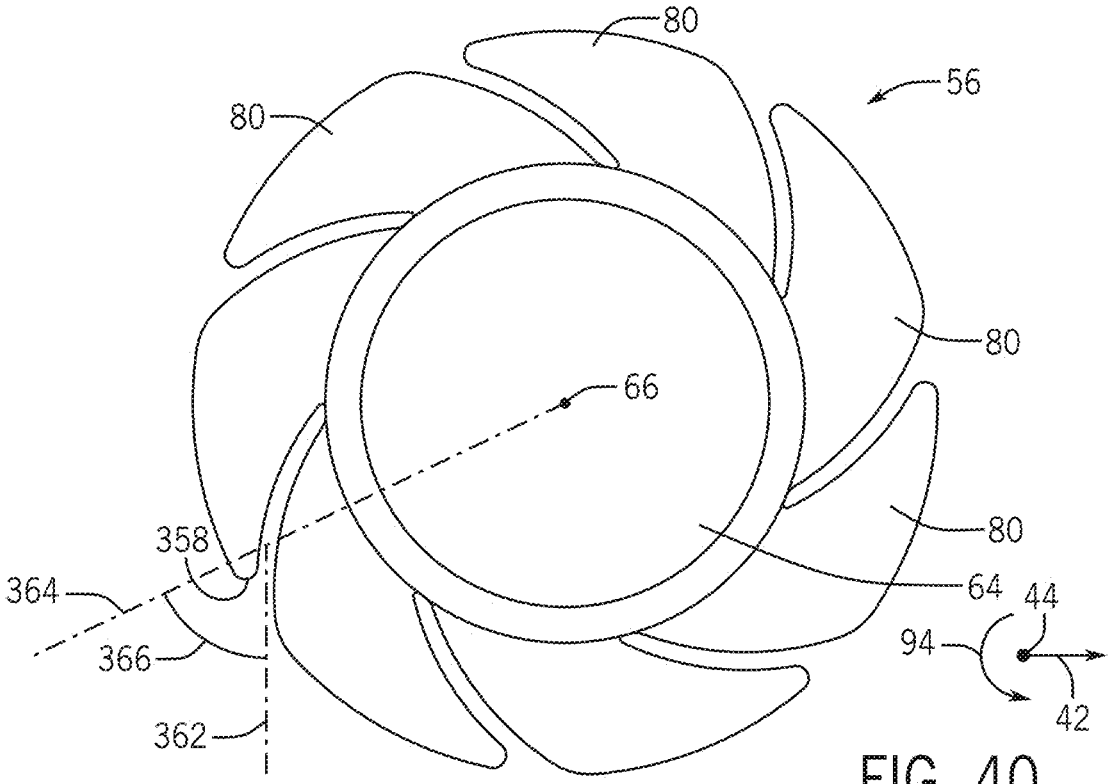
FIG. 40 is a planar top view of an embodiment of a rotor illustrating fan blade sweep angles, in accordance with an embodiment of the present disclosure.

FIG. 40 is a planar top view of an embodiment of the rotor assembly 56. As shown in the illustrated embodiment, the fan blades 80 extend radially from the hub 64 and may arc toward a direction of rotation of the rotor assembly 56 (e.g., in the counter-clockwise direction 94, in a forward sweeping orientation). As an example, in this manner, a tip 358 of one of the fan blades 80 may be oriented along an axis 362 that is offset from a line 364 extending radially from the centerline 66 by an angle 366. As a non-limiting example, the angle 366 may be between 45 degrees and about 80 degrees.

The forward sweeping design of the fan blades 80 may reduce a radial velocity component of air flowing across the fan blades 80 during operation of the fan 40. In some embodiments, reducing radial air flow across the fan blades 80 may diminish broadband noise (e.g., audible noise) that is generated due to turbulent air flow across respective leading edges, trailing edges, and or tip regions of the fan blades 80 (e.g., generated due to separation of airflow from the suction surface 92 and/or tip leakage vortices around the fan blades 80 of shroudless fans). Accordingly, the forward sweeping blade design of the rotor assembly 54 may be used in conjunction with any one or combination of the aforementioned flow directing features to reduce an amount of acoustic energy (e.g., audible noise) generated during operation of the fan 40.

Figure 41:
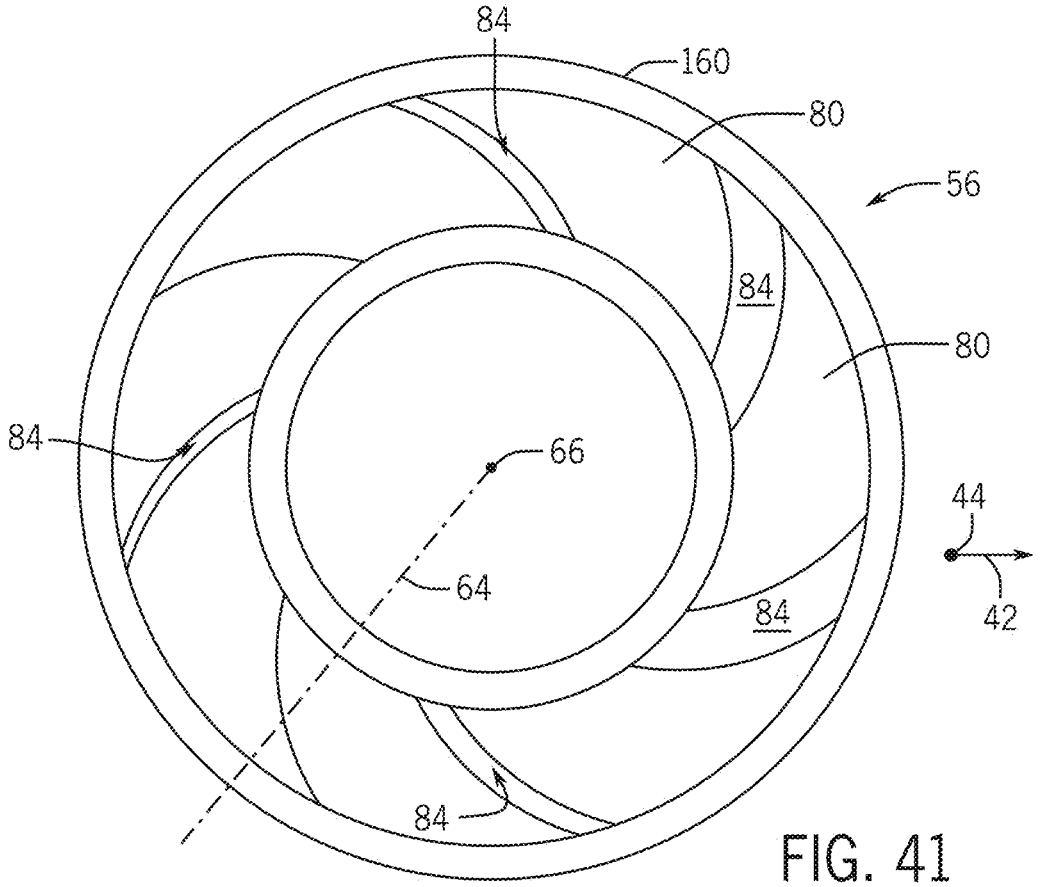
FIG. 41 is a planar top view of an embodiment of a shrouded rotor having variable blade spacing, in accordance with an embodiment of the present disclosure.

FIG. 41 is a planar top view of another embodiment of the rotor assembly 56. As shown in the illustrated embodiment, the fan blades 80 may be located in a non-uniform spacing about the centerline 66, such that a cross-sectional area of one or more of the fluid passages 84 may be different. In some embodiments, this variable blade spacing may further reduce tonal noise (e.g., audible noise) associated with the BPF harmonics (e.g., tonal noise) that may be generated at certain frequencies during operation of the fan 40 by spreading the acoustic energy across a range of frequencies instead of a single frequency.

Figure 42:
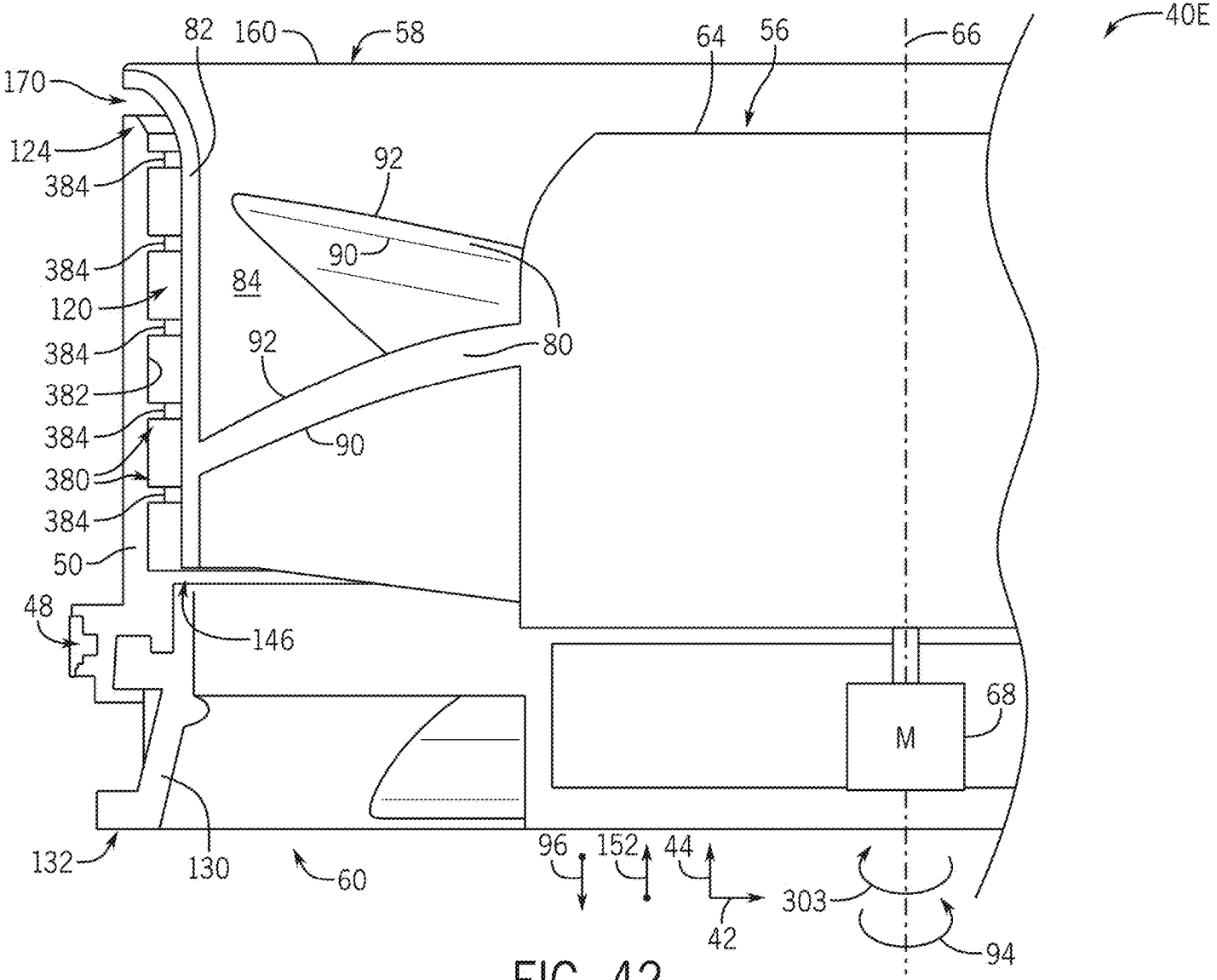
FIG. 42 is a partial cross-sectional view of an example of the fan of FIG. 4 having a stationary flow impedance feature, in accordance with an embodiment of the present disclosure.

In some embodiments, the fans 40A, 40B, 40C, and/or 40D may include a flow impedance feature, or multiple flow impedance features, which are configured to impede or reduce a flow of backflow air through the radial gap 120. For example, FIG. 42 is a partial cross-sectional view of an embodiment of a fan 40E (e.g., any one of the fans 40A, 40B, 40C, and/or 40D) having a flow impedance feature 380 that may be disposed about an inner surface 382 of the outer wall 50. The flow impedance feature 380 may include one or more stationary flow impedance ribs 384 that extend radially from the inner surface 382 and protrude into the radial gap 120. In some embodiments, the stationary flow impedance ribs 384 may each include a rib that extends circumferentially about the inner surface 382 in a symmetric or uniform manner (e.g., with respect to the centerline 66). For example, an axial distance (e.g., along the centerline 66) between the first end portion 124 of the outer wall 50 and a respective one of the stationary flow impedance ribs 384 may be substantially constant about a circumference of the outer wall 50.

As shown in the illustrated embodiment, the stationary flow impedance ribs 384 may constrict several portions of the radial gap 120 to impede a backflow of air along these portions of the radial gap 120. Indeed, by constricting portions of the radial gap 120, the stationary flow impedance ribs 384 may generate a pressure drop along the radial gap 120 in the second direction 152, and thus, impede the flow of backflow air through the radial gap 120 in the second direction 152. In some embodiments, an axial distance between each of the stationary flow impedance ribs 384 (e.g., with respect to the centerline 66) may be substantially equal. In other embodiments, the axial distance between certain of the stationary flow impedance ribs 384 may be different. For example, in some embodiments, the stationary flow impedance ribs 384 positioned near the first end portion 124 of the outer wall 50 may be spaced closer together (e.g., with respect to an axial distance between adjacent stationary flow impedance ribs 384) or further apart to one another as compared to the stationary flow impedance ribs 384 positioned near the second end portion 132 of the outer wall 50. Moreover, in certain embodiments, a radial width (e.g., with respect to the centerline 66) of one or more of the stationary flow impedance ribs 384 may be substantially equal to one another or different from one another. It should be appreciated that the stationary flow impedance ribs 384 may be formed integrally with the outer wall 50.

Figure 43:
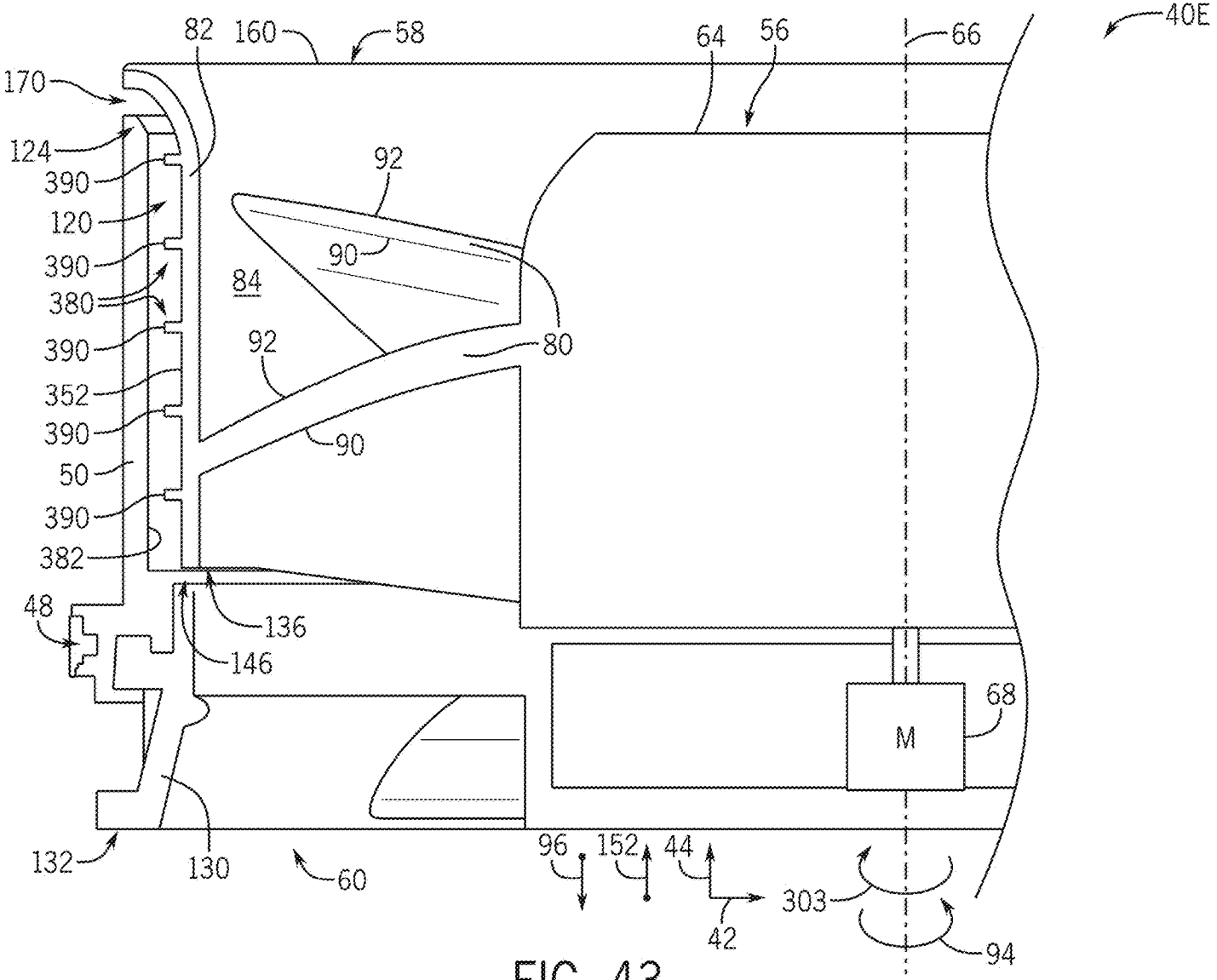
FIG. 43 is a partial cross-sectional view of an example of the fan of FIG. 4 having a rotating flow impedance feature, in accordance with an embodiment of the present disclosure.

FIG. 43 is a partial cross-sectional view of another embodiment of the fan 40E. In some embodiments, the flow impedance feature 380 may be disposed about the exterior surface 352 of the shroud 82 instead of the inner surface 382 of the outer wall 50. Particularly, the flow impedance feature 380 may include one or more rotating flow impedance ribs 390 that extend radially from the exterior surface 352 and protrude into the radial gap 120. In some embodiments, the rotating flow impedance ribs 390 may each include a rib that extends circumferentially about the exterior surface 352 in a symmetric or uniform manner (e.g., with respect to the centerline 66). For example, an axial distance between the downstream end portion 136 of the shroud 82 and a respective one of the rotating flow impedance ribs 390 may be substantially constant about a circumference of the shroud 82.

Similar to the stationary flow impedance ribs 384, the rotating flow impedance ribs 390 may constrict several portions of the radial gap 120 to impede a backflow of air along these portions of the radial gap 120. That is, by constricting portions of the radial gap 120, the rotating flow impedance ribs 390 may generate a pressure drop along the radial gap 120 in the second direction 152, and thus, impede the flow of backflow air through the radial gap 120 in the second direction 152. In some embodiments, an axial distance between each of the rotating flow impedance ribs 390 (e.g., with respect to the centerline 66) may be substantially equal. In other embodiments, the axial distance between certain of the rotating flow impedance ribs 390 may be different. For example, in some embodiments, the rotating flow impedance ribs 390 positioned near the rotating inlet flange 160 may be spaced closer together (e.g., with respect to an axial distance between adjacent rotating flow impedance ribs 390) or further apart to one another as compared to the rotating flow impedance ribs 390 positioned near the downstream end portion 136 of the shroud 82. Moreover, in certain embodiments, a radial width (e.g., with respect to the centerline 66) of one or more of the rotating flow impedance ribs 390 may be substantially equal to one another or different from one another.

It should be appreciated that the rotating flow impedance ribs 390 may be formed integrally with the shroud 82. Accordingly, in some embodiments, the rotating flow impedance ribs 390 may stiffen the shroud 82 to reduce vibration of the shroud 82 and the rotor assembly 56 during operation of the fan 40E. Indeed, in certain embodiments, the rotating flow impedance ribs 390 may reduce or substantially mitigate vibrations that may occur at a natural vibrational frequency of the rotor assembly 56.

Figure 44:
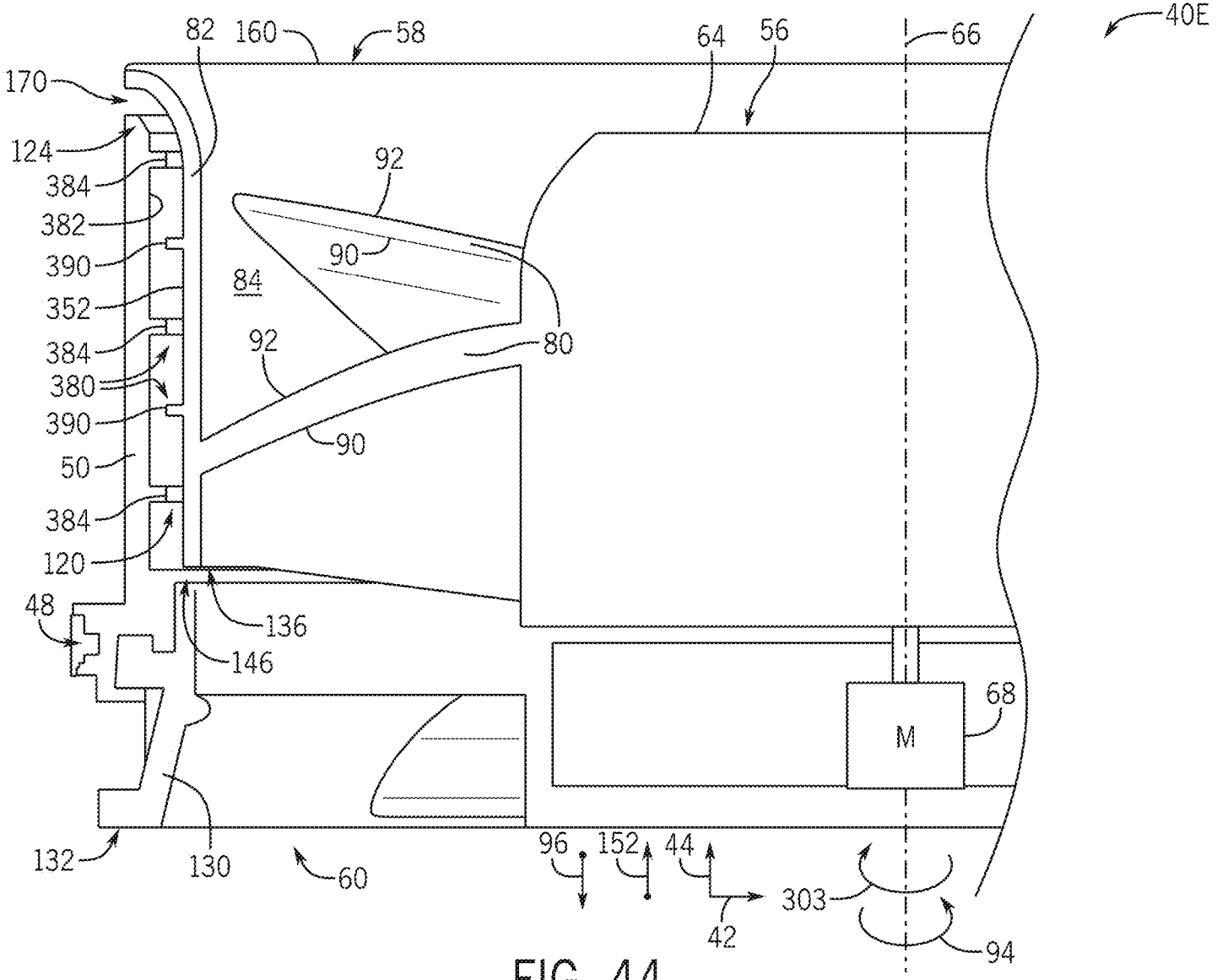
FIG. 44 is a partial cross-sectional view of an example of the fan of FIG. 4 having a stationary flow impedance feature and a rotating flow impedance feature, in accordance with an embodiment of the present disclosure.

In some embodiments, the fan 40E may include both the stationary flow impedance ribs 384 and the rotating flow impedance ribs 390. To better illustrate and to facilitate the following discussion, FIG. 44 is a partial cross-sectional view of an embodiment of the fan 40E that includes the stationary flow impedance ribs 384 and the rotating flow impedance ribs 390. As shown in the illustrated embodiment, the rotating flow impedance ribs 390 may be positioned axially between neighboring stationary flow impedance ribs 384 to form a serpentine flow path that extends along a length of the radial gap 120. In this manner, the stationary flow impedance ribs 384 and the rotating flow impedance ribs 390 may cooperate to impede or to restrict the flow of backflow air along the radial gap 120 in the second direction 152.

It should be appreciated that, in some embodiments, the stationary flow impedance ribs 384 may be axially aligned (e.g., with respect to the centerline 66) with the rotating flow impedance ribs 390. That is, the stationary flow impedance ribs 384 may be configured to extend along the radial axis 42 toward the rotating flow impedance ribs 390. In this manner, the stationary flow impedance ribs 384 and the rotating flow impedance ribs 390 may cooperate to constrict particular portion(s) of the radial gap 120.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A fan for directing a fluid through an enclosure of an electronic device, comprising:

a housing having a channel defined therein, wherein the channel extends from an inlet of the housing to an outlet of the housing;

a rotor assembly positioned within the channel and configured to rotate about a central axis of the channel to direct a fluid flow from the inlet to the outlet, wherein the rotor assembly includes:

a hub;

a plurality of fan blades extending from the hub;

a shroud disposed about a circumference of the plurality of fan blades and coupled to the plurality of fan blades, wherein a radial gap extends between the shroud and the housing, and the radial gap is configured to receive a portion of the fluid flow from the outlet as backflow fluid; and an inlet flange extending from the shroud, wherein the inlet flange is configured to receive the backflow fluid from the radial gap and direct the backflow fluid in a direction away from the inlet prior to discharge of the backflow fluid from the radial gap, wherein the housing includes an outer wall that circumscribes the rotor assembly, wherein the inlet flange extends radially across an end portion of the outer wall to define a vertical gap between the end portion and the inlet flange, and wherein a width of the vertical gap is non-uniform about a circumference of the outer wall to non-uniformly bias discharge of the backflow fluid about the circumference of the outer wall.

2. The fan of claim 1, wherein the inlet flange extends across the outer wall of the housing such that a distal end of the inlet flange is positioned exterior to the channel, wherein the distal end of the inlet flange extends in the direction away from the inlet.

3. The fan of claim 2, wherein the direction away from the inlet extends generally orthogonal to the central axis of the channel.

4. The fan of claim 1, wherein the end portion is a first end portion of the outer wall proximate the inlet, wherein the outer wall has a second end portion proximate the outlet, and wherein the inlet flange curves around the first end portion of the outer wall to direct the backflow fluid generally along an exterior surface of the outer wall toward the outlet.

5. The fan of claim 4, wherein the inlet flange forms an additional radial gap that extends between the inlet flange and the exterior surface of the outer wall, wherein a width of the additional radial gap is substantially constant along a length of the additional radial gap.

6. The fan of claim 1, wherein the outer wall includes a height profile that defines the width of the vertical gap, wherein the height profile includes a pair of crest points forming constricted sections of the vertical gap configured to discharge the backflow fluid at a first flow rate and a pair of trough points forming expanded sections of the vertical gap configured to discharge the backflow fluid at a second flow rate that is greater than the first flow rate.

7. The fan of claim 6, wherein the pair of crest points are positioned diametrically opposite one another along the outer wall and the pair of trough points are positioned diametrically opposite one another along the outer wall, wherein a first axis extending through the pair of crest points extends generally orthogonal to a second axis extending through the pair of trough points.

8. A fan for directing a fluid through an enclosure of an electronic device, comprising:

a housing having a channel defined therein, wherein the channel extends from an inlet of the housing to an outlet of the housing;

a rotor assembly positioned within the channel and configured to rotate about a central axis of the channel to direct a fluid flow in a downstream direction along the central axis from the inlet to the outlet, wherein the rotor assembly includes:

a hub;

a plurality of fan blades extending from the hub;

a shroud disposed about a circumference of the plurality of fan blades and coupled to the plurality of fan blades, wherein a radial gap extends between the shroud and the housing, and the radial gap is configured to receive a portion of the fluid flow from the outlet as backflow fluid; and a flow mitigation feature protruding radially from the shroud and extending into the radial gap, wherein the flow mitigation feature includes a protrusion that extends from an exterior surface of the shroud and spirals helically about the exterior surface, wherein, during rotation of the rotor assembly, the protrusion is configured to engage with the backflow fluid occupying the radial gap to force an additional portion of the backflow fluid in the downstream direction along the central axis to generate a pressure within the radial gap that reduces a flow rate of the backflow fluid entering the radial gap.

9. The fan of claim 8, wherein the protrusion spirals helically about and along the central axis from the inlet toward the outlet.

10. The fan of claim 8, wherein the rotor assembly includes an inlet flange extending from the shroud, wherein the inlet flange is configured to receive the additional portion of the backflow fluid from the radial gap and direct the additional portion of the backflow fluid in a direction away from the inlet prior to discharge of the additional portion of the backflow fluid from the radial gap.

11. The fan of claim 10, wherein the direction away from the inlet extends generally orthogonal to the central axis of the channel.

12. The fan of claim 8, wherein the hub and the plurality of fan blades collectively form a blade assembly, wherein the shroud includes a plurality of grooves formed within an interior surface of the shroud, and wherein the plurality of grooves is configured to receive and engage with the plurality of fan blades to couple the blade assembly to the shroud.

13. The fan of claim 12, wherein an aperture is formed within each groove of the plurality of grooves, wherein a blade protrusion extends radially from each fan blade of the plurality of fan blades, and wherein respective blade protrusions of the plurality of fan blades are configured to engage with corresponding apertures of the plurality of grooves upon insertion of the blade assembly into the shroud to couple the blade assembly to the shroud via a snap fit.

14. A flow generation unit for directing a fluid through an enclosure of an electronic device, comprising:

a housing having a first outer wall that defines a first channel through the housing and a second outer wall that defines a second channel through the housing;

a first fan including a first rotor assembly positioned within the first channel and configured to direct a respective fluid flow from an inlet of the first channel to an outlet of the first channel, wherein the first rotor assembly includes a first inlet flange that extends across the first outer wall to form a first vertical gap between the first inlet flange and the first outer wall, wherein the first vertical gap is configured to receive a portion of the respective fluid flow from the outlet of the first channel as backflow fluid of the first fan, and wherein the first inlet flange is configured to discharge the backflow fluid of the first fan through the first vertical gap in a direction away from the inlet of the first channel; and a second fan including a second rotor assembly positioned within the second channel and configured to direct a respective fluid flow from an inlet of the second channel to an outlet of the second channel, wherein the second rotor assembly includes a second inlet flange that extends across the second outer wall to form a second vertical gap between the second inlet flange and the second outer wall, wherein the second vertical gap is configured to receive a portion of the respective fluid flow from the outlet of the second channel as backflow fluid of the second fan, wherein the second inlet flange is configured to discharge the backflow fluid of the second fan through the second vertical gap in a direction away from the inlet of the second channel, and wherein the first vertical gap of the first fan and the second vertical gap of the second fan each include a respective constricted section having a relatively narrow width and a respective expanded section having a relatively large width to non-uniformly bias discharge of the backflow fluid of the first fan about a circumference of the first outer wall and to non-uniformly bias discharge of the backflow fluid of the second fan about a circumference of the second outer wall.

15. The flow generation unit of claim 14, wherein the respective constricted section of the first vertical gap and the respective constricted section of the second vertical gap are positioned substantially adjacent one another and the respective expanded section of the first vertical gap and the respective expanded section of the second vertical gap are positioned substantially opposite one another to mitigate interaction between the backflow fluid of the first fan and the backflow fluid of the second fan.

16. A fan for directing a fluid through an enclosure of an electronic device, comprising:

a housing having an outer wall that defines a channel, wherein the channel extends from an inlet of the housing to an outlet of the housing; and a rotor assembly positioned within the channel and configured to rotate about a central axis of the channel to direct a fluid flow in a downstream direction along the channel from the inlet to the outlet, wherein the rotor assembly includes:

a hub;

a plurality of fan blades extending from the hub;

a shroud disposed about a circumference of the plurality of fan blades and coupled to the plurality of fan blades, wherein a radial gap extends between the shroud and the housing, and the radial gap is configured to receive a portion of the fluid flow from the outlet as backflow fluid; and an inlet flange extending from the shroud, wherein the inlet flange protrudes beyond the plurality of fan blades and beyond the outer wall in an upstream direction, opposite the downstream direction, and wherein the inlet flange is configured to receive the backflow fluid from the radial gap and direct the backflow fluid in a direction away from the inlet prior to discharge of the backflow fluid from the radial gap.

17. The fan of claim 16, wherein the outer wall circumscribes the rotor assembly, wherein the inlet flange extends radially across an end portion of the outer wall to define a vertical gap between the end portion and the inlet flange, and wherein a height of the outer wall is such that the vertical gap is positioned upstream of the plurality of fan blades, with respect to the downstream direction of the fluid flow along the channel.

18. A fan for directing a fluid through an enclosure of an electronic device, comprising:

a housing having a channel defined therein, wherein the channel extends from an inlet of the housing to an outlet of the housing;

a rotor assembly positioned within the channel and configured to rotate about a central axis of the channel to direct a fluid flow from the inlet to the outlet, wherein the rotor assembly includes:

a hub;

a plurality of fan blades extending from the hub;

a shroud disposed about a circumference of the plurality of fan blades and coupled to the plurality of fan blades, wherein a radial gap extends between the shroud and the housing, and the radial gap is configured to receive a portion of the fluid flow from the outlet as backflow fluid; and a flow mitigation feature protruding radially from the shroud and extending into the radial gap, wherein, during rotation of the rotor assembly, the flow mitigation feature is configured to engage with the backflow fluid occupying the radial gap to generate a pressure within the radial gap to reduce a flow rate of the backflow fluid entering the radial gap, wherein the flow mitigation feature includes a fan blade of the plurality of fan blades, and wherein the fan blade extends through an exterior surface of the shroud to protrude past the exterior surface of the shroud.

19. A flow generation unit for directing a fluid through an enclosure of an electronic device, comprising:

a housing having a first outer wall that defines a first channel through the housing and a second outer wall that defines a second channel through the housing;

a first fan including a first rotor assembly positioned within the first channel and configured to direct a respective fluid flow from an inlet of the first channel to an outlet of the first channel, wherein the first rotor assembly includes a first inlet flange that extends across the first outer wall to form a first vertical gap between the first inlet flange and the first outer wall, wherein the first vertical gap is configured to receive a portion of the respective fluid flow from the outlet of the first channel as backflow fluid of the first fan, and wherein the first inlet flange is configured to discharge the backflow fluid of the first fan through the first vertical gap in a direction away from the inlet of the first channel; and a second fan including a second rotor assembly positioned within the second channel and configured to direct a respective fluid flow from an inlet of the second channel to an outlet of the second channel, wherein the second rotor assembly includes a second inlet flange that extends across the second outer wall to form a second vertical gap between the second inlet flange and the second outer wall, wherein the second vertical gap is configured to receive a portion of the respective fluid flow from the outlet of the second channel as backflow fluid of the second fan, wherein the second inlet flange is configured to discharge the backflow fluid of the second fan through the second vertical gap in a direction away from the inlet of the second channel, wherein the first outer wall includes a first wall height to position the first vertical gap of the first fan at a first height and the second outer wall includes a second wall height that is less than the first wall height to position the second vertical gap of the second fan at a second height that is less than the first height, such that the first vertical gap is configured to discharge the backflow fluid of the first fan at the first height and the second vertical gap is configured to discharge the backflow fluid of the second fan at the second height to mitigate interaction between the backflow fluid of the first fan and the backflow fluid of the second fan.

20. The flow generation unit of claim 19, wherein the second inlet flange of the second fan includes a circumferential end face that extends toward the second outer wall in a direction generally parallel to the second outer wall, wherein the first vertical gap of the first fan is configured to discharge the backflow fluid of the first fan onto the circumferential end face of the second inlet flange of the second fan.

* * * * *